US009883732B2

(12) United States Patent
Palma

(10) Patent No.: US 9,883,732 B2
(45) Date of Patent: Feb. 6, 2018

(54) SMART RETRACTABLE HOLSTER HARNESS SYSTEM FOR ELECTRONIC DEVICES

(71) Applicant: Palms Free Inc., Valley Stream, NY (US)

(72) Inventor: Gary Palma, Valley Stream, NY (US)

( * ) Notice: Subject to any disclaimer, the term of this patent is extended or adjusted under 35 U.S.C. 154(b) by 323 days.

(21) Appl. No.: 14/447,693

(22) Filed: Jul. 31, 2014

(65) Prior Publication Data

US 2015/0076183 A1 Mar. 19, 2015

Related U.S. Application Data

(60) Provisional application No. 61/861,285, filed on Aug. 1, 2013.

(51) Int. Cl.
*A45F 5/00* (2006.01)
*A45F 3/14* (2006.01)

(52) U.S. Cl.
CPC ..... *A45F 5/004* (2013.01); *A45F 2003/142* (2013.01); *A45F 2005/006* (2013.01); *A45F 2200/0516* (2013.01)

(58) Field of Classification Search
CPC ..... A45F 5/004; A45F 2003/142; A45F 2005/006; A45F 2200/0516
See application file for complete search history.

(56) References Cited

U.S. PATENT DOCUMENTS

2007/0212931 A1* 9/2007 Livingston ..... A45F 5/00 439/501
2010/0171021 A1* 7/2010 Smith ..... A45C 13/30 248/558
2010/0206922 A1* 8/2010 Gross ..... A45F 5/004 224/162
2013/0181083 A1* 7/2013 Salentine ..... B65H 75/48 242/399.2
2014/0175135 A1* 6/2014 Paugh ..... A45F 5/004 224/219
2015/0097008 A1* 4/2015 Adeyemi ..... A45F 5/004 224/162
2015/0311938 A1* 10/2015 Molnar ..... H04B 1/3888 455/575.8
2016/0286942 A1* 10/2016 Peterson ..... A45F 5/00

* cited by examiner

*Primary Examiner* — Corey Skurdal
(74) *Attorney, Agent, or Firm* — John F. Vodopia

(57) ABSTRACT

A retractable holder for a smartphone is formed with a housing, a connection mechanism for connecting and disconnecting the smartphone to the housing, a first lanyard loop comprising lanyard cords that are reeled onto or deployed from cord storage spools located inside the housing, a second lanyard loop comprising lanyard cords that are reeled onto or deployed from cord storage spools located inside the housing and a lanyard control mechanism. The lanyard control mechanism applies a retracting force to each of the cord storage spools, the retracting force operational to reel the lanyard cord extending from the housing in a deployed state to the cord's respective cord storage spool and to enable a user draw out and deploy a fixed length of the lanyard cord from the cord's respective cord storage spool.

6 Claims, 19 Drawing Sheets

FIG. 14A
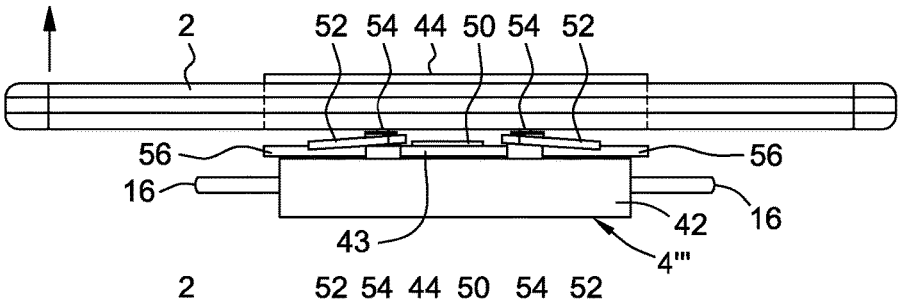
FIG. 14B
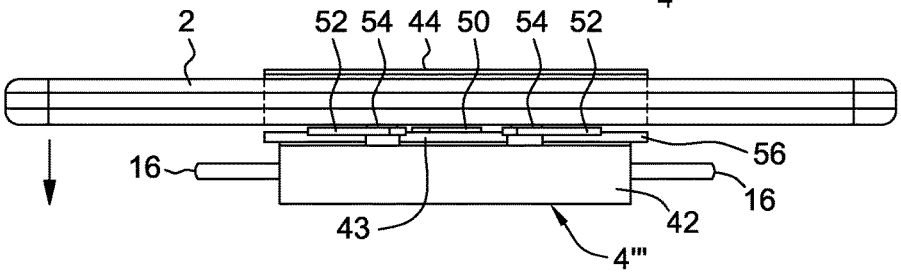
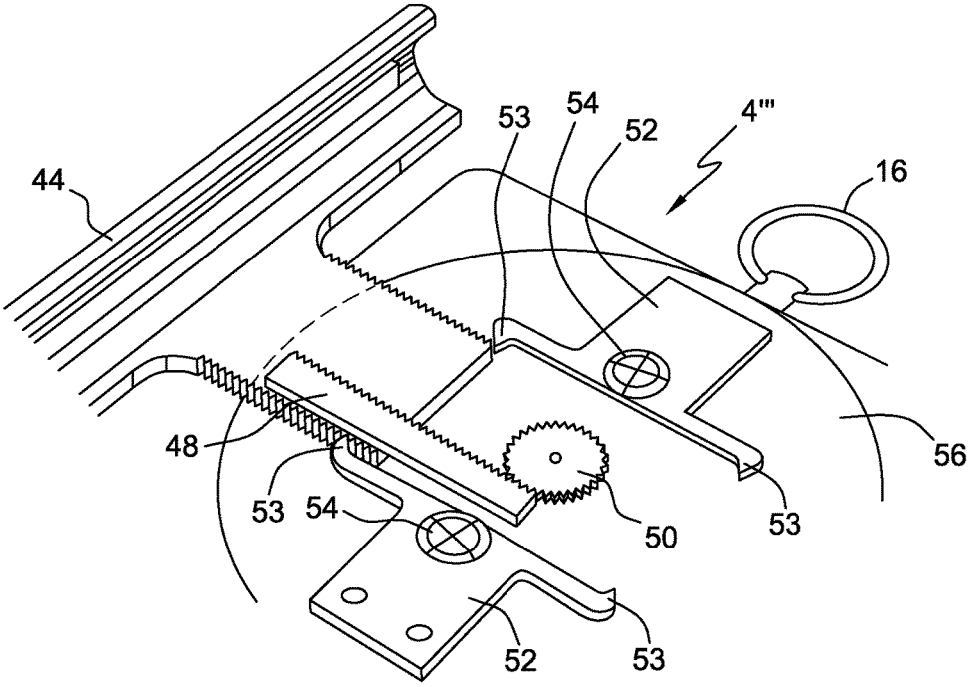
FIG. 15

SMART RETRACTABLE HOLSTER HARNESS SYSTEM FOR ELECTRONIC DEVICES

CROSS-REFERENCE TO A RELATED APPLICATION

The invention described and claimed hereinbelow claims priority under 35 USC § 120 from U.S. Provisional Patent Application Ser. No. 61/861,285, filed Aug. 1, 2013, and from U.S. Provisional Patent Application Ser. No. 61/948,861, filed on Mar. 6, 2014, the contents of both of which incorporated by reference herein.

BACKGROUND OF THE INVENTION

The invention relates to a smart retractable holster harness system for electronic devices such as a smartphones and cameras.

The use of mobile electronic devices such as hand-held cameras and cellular telephones, e.g., smartphones, has increased dramatically over the last several years. These mobile electronic devices are typically held in a user's hand(s) during use. For example, a user will typically hold a mobile phone in his or her left or right hand to carry out a conversation, where the phone is held to one or the other ears. While many people use one or the other hand to utilize a cellular phone camera, others may hold a smartphone to focus and capture an image using only one hand. Likewise, users are known to use one or both hands for texting on mobile cellular phones. Please note that the terms "cellular phone," "cell phone," "mobile phone," "smart phone," "phone," "mobile electronic device," "device," "pad," "iPad," are used interchangeably herein in association with telephonic mobile electronic devices.

Many mobile phone users try to perform physical tasks while concurrently using their cell phones or other hand-held electronic devices. This can be a challenging experience, whether the task requires only one hand or both. One who is performing a task while concurrently speaking has a tendency to focus on the task and the conversation, "forgetting" that the physical electronic hand-held device is part of the action, somewhat akin to forgetting about the glass when viewing an outside scene through a closed window from the inside. And as anyone who has tried to hold a cell phone to their ear using their shoulder, in order to have a conversation while their hands remain free to perform tasks knows that such coordination, over time, is easier said than done. Many times, the cell phone, because of its size, slips from its position between shoulder and ear. Not only is this disruptive to the conversation taking place, but can also damage the phone, e.g., falling into the sink, a puddle, a plate of pasta, etc., without limitation.

U.S. Pat. No. 8,408,513 discloses a holder system for mobile device that comprises a generally rectangular holder base and a holder configured to secure the mobile device therein. The holder is removably attached to the holder base. A retractor mechanism is attached to the holder base. The holder base includes a pair of attached cord ports, each for receiving a line of a retractable cord that is engaged to the retractor mechanism. The figures show the device connected to the holder by the cords at two points (at the ports) in the upper corners of the substantially rectangular device, which allows the device to swing away from the body with gravity and user movements.

US Pub. No. 2012/0248160, for example, discloses a hands-free holder for a portable electronic device comprising a pouch with a first opaque side and a substantially translucent second side, an open top and attached strap. While the pouch does hold an electronic device, it connects to the body with a strap affixed to respective upper corners of the substantially rectangular pouch. The strap is positioned on the body at the user's neck. Hence, the pouch and its contents swing free with gravity and/or user movement, which can interfere with a user's actions, like the invention found in U.S. Pat. No. 8,408,513.

SUMMARY OF THE INVENTION

The present invention overcomes the shortcomings of known arts, such as those mentioned above.

To that end, the present invention provides a retractable holder for a hand-held electronic device, such as a mobile cellular phone or camera that allows for trouble-free and hands-free use of the mobile phone or device (intended to be hand held).

In an embodiment, the retractable holder for a hand-held device includes a housing with a device-facing surface and a body-facing surface, means for connecting and disconnecting a hand-held electronic device to the device-facing surface of the housing, a first lanyard loop comprising lanyard cords that are reeled onto or deployed from cord storage spools located inside the housing, a second lanyard loop comprising lanyard cords that are reeled onto or deployed from cord storage spools located inside the housing and a lanyard control mechanism. The lanyard control mechanism is configured to apply a retracting force to each of the cord storage spools, the retracting force operational to reel the lanyard cord extending from the housing in a deployed state to the cord's respective cord storage spool, and to enable a user draw out and deploy a fixed length of the lanyard cord from the cord's respective cord storage spool by applying a drawing force in excess of the retracting force.

The cord storage spools are spring-loaded to affect the retracting force. The cord storage spools include a gear device, with gear teeth on an outer circumferential surface, that is attached to or integral with the spools and wherein the lanyard control mechanism includes means for locking the gear device to prevent the cord storage spools from turning with the retracting force and unlocking the gear device to enable the cord storage spools to turn with the retracting force and reel the deployed lanyard cord.

The means for operating includes pawls that engage the gear teeth on the gear device to lock the spool and prevent reeling the retracting force and disengage the gear teeth to unlock the spool and enable reeling with the retracting force. The means for operating includes a ring connected to the pawls and configured to be drawn away from the housing to disengage the pawls from the gear teeth and pushed into the housing to engage the pawls to the gear teeth.

In one embodiment, the means for connecting and disconnecting comprises a Velcro patch positioned on both a device-facing surface of the housing and on a back surface of a hand-held electronic device.

In an embodiment, the means for connecting and disconnecting comprise substantially cylindrical male and female parts, that are fixed to the housing and device respectively, and which cooperate to interlock while allowing for sliding rotational movement of the male part with respect to the female part, for example, in a pathway. Those skilled in the art should recognize that either of the cylindrical male and female parts may be positioned on the holder or on the device (as long as there is one of each) without deviating from the scope and spirit of the invention.

In an embodiment, the means for connecting and disconnecting comprises at least two clips arranged on the housing configured to receive and securely hold a hand-held electronic device. Preferably, the means for connecting and disconnecting comprises a plate to which the hand-held electronic device is detachably connected and wherein the plate is detachably connected to a device-facing surface of the housing.

The means for connecting and disconnecting may comprise at least two clips arranged on the plate configured to receive and securely hold the device and wherein the plate and the housing are configured with a male and female connector, respectively, for detachable connecting the plate to the hosing. Preferably, the means for connecting and disconnecting comprises gripping rails positioned relative the device-facing surface of the housing, wherein a hand-held device is positioned between the gripping rails and wherein the gripping rails are configured to clamp and hold the device in a first operational state and to unclamp and release the device in a second operational state.

Each of the gripping rails are formed with a device gripping portion and an arm or extension portion that extends inwardly from each device gripping portion towards the axial center of the holder and wherein each of the extension portions is configured with teeth on both sides and with a flat side rack attached to an upper surface proximate an inner of the two sides. The side rack of each arm or extension portion is configured to mesh with an alignment gear with an axial center that is connected at the gear axial center to the axial center of the rotatable pivot plate, to rotate relative the rotatable pivot plate synchronously with translational movement of the side racks and, therefore, the gripping rails, towards or away from the axial center of the pivot plate to accommodate hand-held electronic devices defined by varying widths.

Also, the means for connecting and disconnecting further comprises locking pawl plates fastened to a device-side surface of the rotating pivot plate and configured to mesh to an outer side of each arm or extension portion when a hand-held electronic device is locked to the holder and, a rotatable pivot plate mounted to the device-facing surface of the housing upon which the gripping rails are operatively arranged.

In an embodiment, the invention provides a method of using a retractable holder or harness for a hand-held electronic device formed with a housing to which the device is to be connected, means for connecting and disconnecting the device to the housing, first and second lanyard loops, each configured with a pair of lanyard cords, to extend from and partially retract into the housing and a lanyard control mechanism arranged in the housing to control a length of lanyard cords.

The method comprises positioning a hand-held electronic device proximate the housing of the retractable holder using the means for connecting and disconnecting, locking the hand-held electronic device to the housing and drawing the first and second lanyard loops away from the housing in order to attach the first and second lanyard loops and, therefore, the holder and device locked thereto, to a user's body. The drawing includes defining a length of each lanyard cord so that the device is positioned on the body at a preferred body position.

The method also includes operating the device while the device is at the preferred body position by grasping the device and drawing it away from the body against a retracting force imposed by the lanyard control mechanism on the lanyard cords. The step of can include drawing includes operating the retractable holder as a harness.

In another embodiment, the invention provides a harness for a hand-held electronic device. The harness comprises a holder with a device-facing surface and a body-facing surface, means for connecting and disconnecting a hand-held electronic device to the device-facing surface of the holder, a harness assembly comprising at least two interconnected straps that is configured to detachably connect with the holder and with a body of a user, the at least two interconnected straps have respective first and second ends with reel cartridges for releaseably storing lanyard cords that extend against a retracting force to connect to the holder at four connecting locations and maintain the holder at a fixed location against a user's body when deployed.

BRIEF DESCRIPTION OF THE DRAWINGS

Further features and advantages of the invention will become apparent from the description of embodiments that follows, with reference to the attached figures, wherein:

FIG. 14A depicts the holder of FIGS. 8-13 where the hand-held electronic device (e.g., phone) is not engaged with teeth on holder rails;

FIG. 14B depicts the holder of FIG. 14A where the device (e.g., phone) is engaged with teeth on the rails;

FIG. 15 presents a perspective partial cutaway view of the retractable holder to highlight certain functionality;

DETAILED DESCRIPTION OF THE INVENTION

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1A:
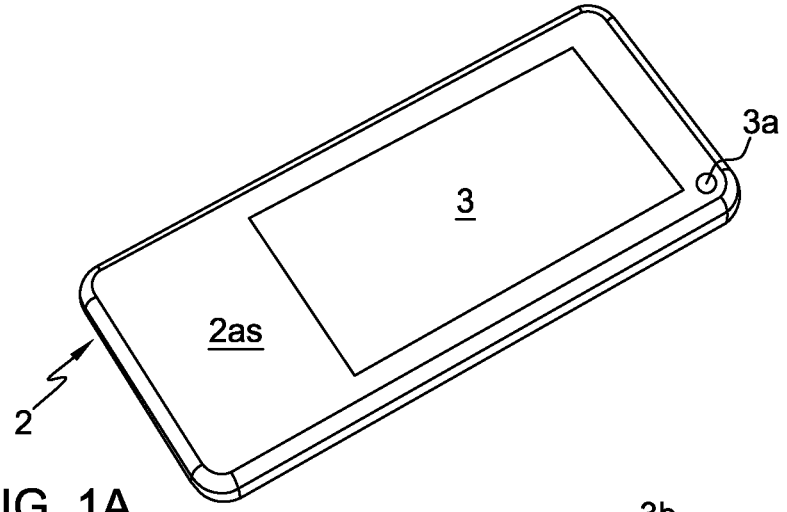
FIG. 1A depicts a front side of a hand-held electronic device that is used with the retractable holder of the invention.
Figure 1B:
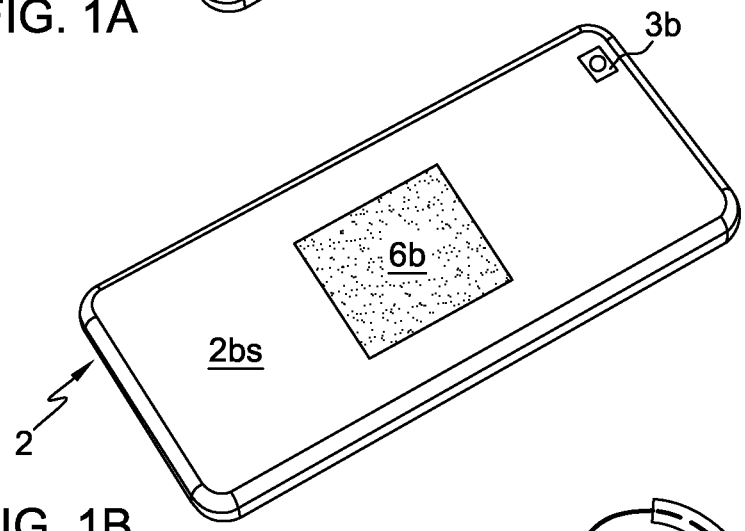
FIG. 1B depicts a rear side of the hand-held electronic device of FIG. 1A.

FIG. 1A depicts a hand-held electronic device 2 (in the form of a smartphone), in a front perspective view. While the hand-held electronic device 2 is depicted as a smartphone, the invention is not limited to use with smartphones but may be used with any hand-held or portable electronic device that a user might wish to carry on their body or operate "hands free", by use of the retractable holder of this invention. Hence, the terms hand-held electronic device, mobile device, portable device, device, cellular phone, smartphone, etc., without limitation, are used interchangeably herein to describe devices for use with the inventive retractable holder. As shown, the device or smartphone 2 includes inter alia a display part 3 on a front surface 2*as* and a front camera mechanism 3*a*. FIG. 1B depicts the back of the smartphone 2 of FIG. 1A, including back surface 2*bs*, camera mechanism 3*b* and a Velcro patch 6*b*, to be discussed in greater detail below.

Figure 1C:
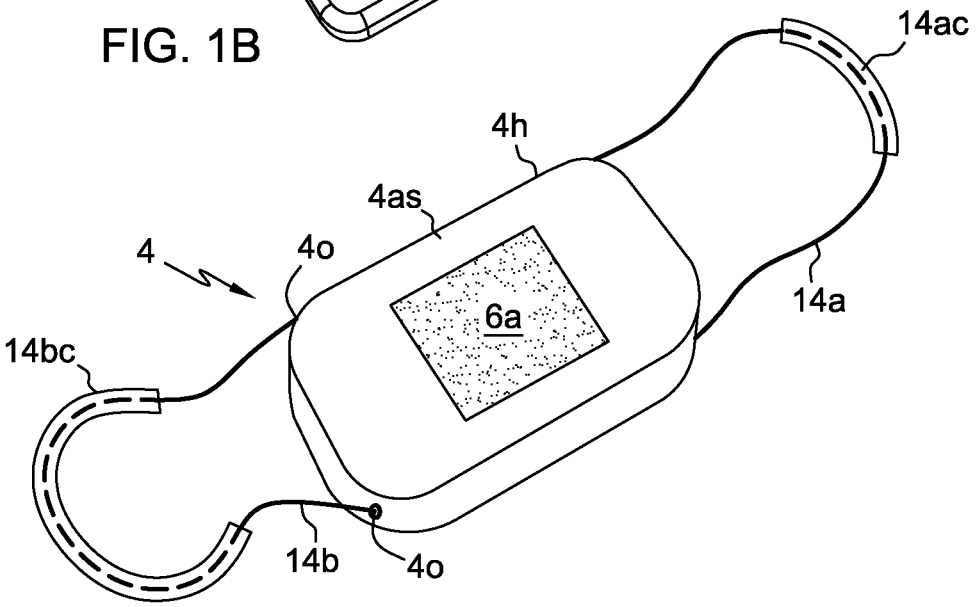
FIG. 1C depicts an embodiment of a retractable holder of the invention.

FIG. 1C depicts an embodiment of the retractable holder 4. The holder 4 of the FIG. 1C embodiment includes a rectangular housing 4*h* having front and back surfaces (4*as*, 4*bs*) and four sides, with lanyard loops 14*a* and 14*b*, each comprising 2 lanyard cords that extend from and retract to spools on which the separate cords are maintained (via openings or ports 4*o*). First and second lanyard loops 14*a* and 14*b* enable attaching the holder 4 to an operational position on the user's torso, waist, leg, abdominal area, front, back, without limitation. The body location is defined by user determined lengths of the four lanyard cords, in one embodiment. While the lengths may be fixed, an alternative embodiment configures the length to be constantly adjustable during use, defined by 4 opposing retracting forces provided by the spring-loaded nature of the respective lanyard spools positioned in the housing, without stops. The 4 reeling or retracting forces imposed respectively on each of the 4 lanyard cords operate together to define a fixed user position.

The lanyard loops 14*a*, 14*b* may include cushioning members 14*ac*, 14*bc*, to make the wearing of the lanyards (and therefore the retractable holders) more comfortable. The cushioning members 14*ac*, 14*bc* operate to soften and spread the "pull" against the user's neck, waist, arm, legs, etc., by the cords of the lanyard loops 14*a*, 14*b*. During the various uses, the lanyard loops 14*a*, 14*b* and, therefore, the cushioning members 14*ac*, 14*bc*, may come into contact with a user's neck, waist, arms, legs, wrists, etc., as user can attach the holder and lanyard loops and, therefore, the retractable holder in any imaginable way. The holder so defined may be looped around body parts, such as the neck or waist, or worn in a form of a harness.

The front surface 4*as* of the housing 4*h* is for facing or contacting the smartphone 2 (e.g., at device surface 2*bs*), where the back surface 4*bs* of the housing 4*h* faces and/or contacts the user's body. While FIG. 1C shows the housing 4*h* of retractable holder 4 as comprising four sides with rounded corners, the embodiment is presented for exemplary purposes only and is not meant to limit the invention in any way. For example, the corners could be "square," the rectangle could be a square, or the housing could be round, triangular, etc., without deviating from the scope and spirit of the invention.

While not shown in FIG. 1C, the two cords comprising each of the two respective lanyards 14*a*, 14*b* are retractably maintained on reels or spools 40. The holder 4 preferably includes a lanyard control mechanism for fixing an amount of one or both cords of each lanyard loop 14*a*, 14*b*, extending from the holder housing (at 4*o*). In an embodiment, the reels or spools 40 are attached to spring-loaded gear plates 38, to allow the spools to operate in a ratchet-like manner, which will be explained in greater detail below herein with reference to FIG. 17D. The gear plates 38 and corresponding rotational position of the spools 40 (and therefore, the length of each respective lanyard cord) is fixed in place to prevent rewinding, in accordance with conventional ratchet operation. The retractable holder is held in place at a user-defined position against the body by the opposing retracting forces of four spring-loaded spools (associated with each lanyard cord or line), or after user-defined cord lengths are locked (fixed by a locking mechanism) by the lanyard control mechanism.

The lanyard control mechanism enables the holder to be fixedly maintained at one vertical and horizontal position with respect to the user's body, regardless of any further pulling, gravitational or movement-induced force that might otherwise operate to further extend the lanyard cords. As already explained, the retractable holder 4 is designed to be positioned at a body position defined by the lengths extending from the four openings 4*o*. For example the holder may be positioned vertically with loop 14*a* wrapped or looped around the user's neck and the loop 14*b* wrapped or looped about a user's waist. As should be clear, the cords of each lanyard loop 14*a*, 14*b*, may be fixed at different lengths, to variably define the body position relative to the two locations at which the loops 14*a*, 14*b* themselves contact the body (see FIGS. 7A-J).

So, for example, where a smartphone 2 is attached to the holder 4, held in place by the first and second lanyard loops 14*a*, 14*b*, the holder/phone is available for hands free use, even in a case where the user bends over, during work or play. For that matter, fixing the holder 4 and device 2 at a body location enables use of the smartphone 2 in that position, for example, to capture still photos of streaming video, make calls with or without voice activated assistance, etc., without limitation.

The retractable holder 4 may embody various means for connecting and disconnecting a hand-held electronic device 2 to the holder housing 4*h*, for example, to the device-facing surface 4*as*. As shown in FIG. 1C, a Velcro fastener in the form of a patch 6*a* is affixed to the device-facing surface 4*as*. A like Velcro patch 6*b* is attached to the back (for example, glued), holder-facing side of the device 2. The Velcro surfaces 6*a*, 6*b* provides for detachable connection of the hand-held device 2 to the holder 4. The Velcro patch 6*b* should be adhered to back surface 2*bs* of the device in a way that it will not interfere with the rear or main camera mechanism 3*b*.

Figure 1D:
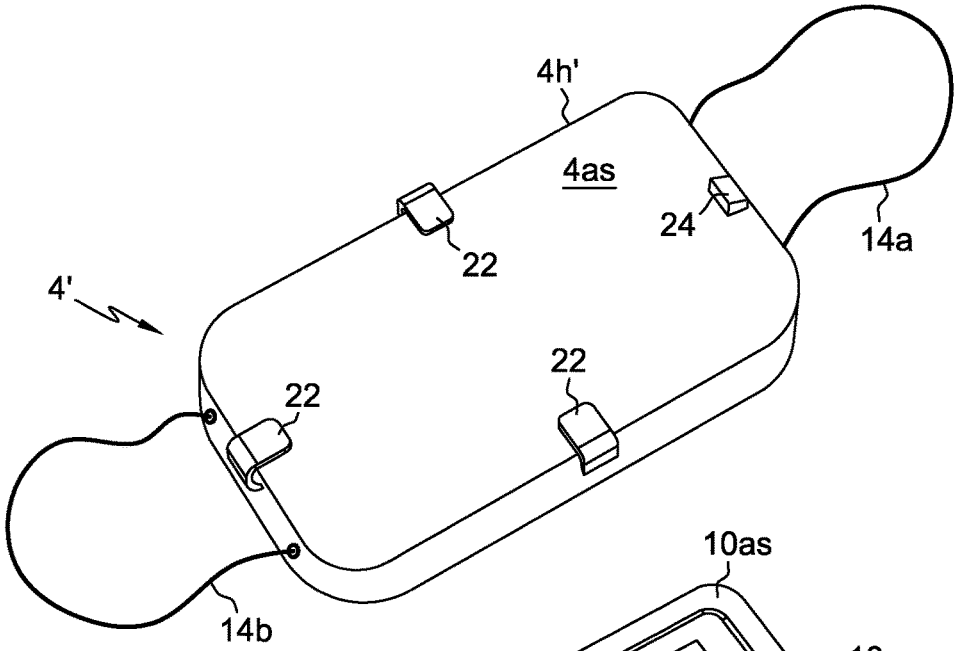
FIG. 1D depicts another embodiment of the retractable holder of the invention.

FIG. 1D shows retractable holder 4' that includes an alternative means for connecting and disconnecting a hand-held electronic device 2. That is, the FIG. 1D embodiment includes a number of adjustable clips 22 for receiving and holding a hand-held electronic device 2 against the device-facing surface 4*as*. While not drawn to scale, the FIG. 1D embodiment is larger than the FIG. 1C embodiment, slightly larger than the device 2 that the holder 4' will detachably maintain. The adjustable clips 22 are moved horizontally in channels toward the device 2 and contact the device 3.

The adjustable clips 22 operate in cooperation with a top retaining clip 24 (see FIG. 6C), which top retaining clip 24 is configured to move down (against a spring-like force when a downward force is applied by a user's fingers) into a (fixed) depressed position so that the clip's upper surface is below or flush with a plane of the surface 4*as* (i.e., depressed into the housing). In the depressed position or state of retaining clip 24, the hand-held device 2 can slide past the (depressed) clip 24 into a position against the adjustable clips 22, as positioned. Once, the smartphone 2 slides past the inner most edge of the depressed retaining clip 24, and any applied pressure holding the clip down is withdrawn, a portion of the retaining clip 24 springs or "pops" up into its locking position, preventing the hand-held device 2 from sliding back (away from the adjustable clips 22 in their final respective positions) over the retaining clip 24. That is, the device 2 can then no longer move or slide laterally away from clips 22 (over the clip 24) to separate the device 2 from the holder 4. The FIG. 1D embodiment obviates the need for attaching a Velcro patch to the hand-held device 2 and holder 4', respectively.

Figure 1E:
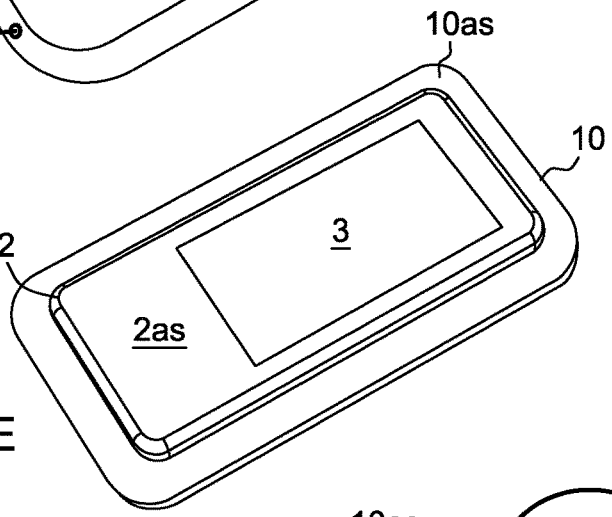
FIG. 1E depicts a hand-held electronic device (e.g., a smartphone) attached to a device contacting surface of backing plate included and used with the FIG. 1D embodiment.
Figure 1F:
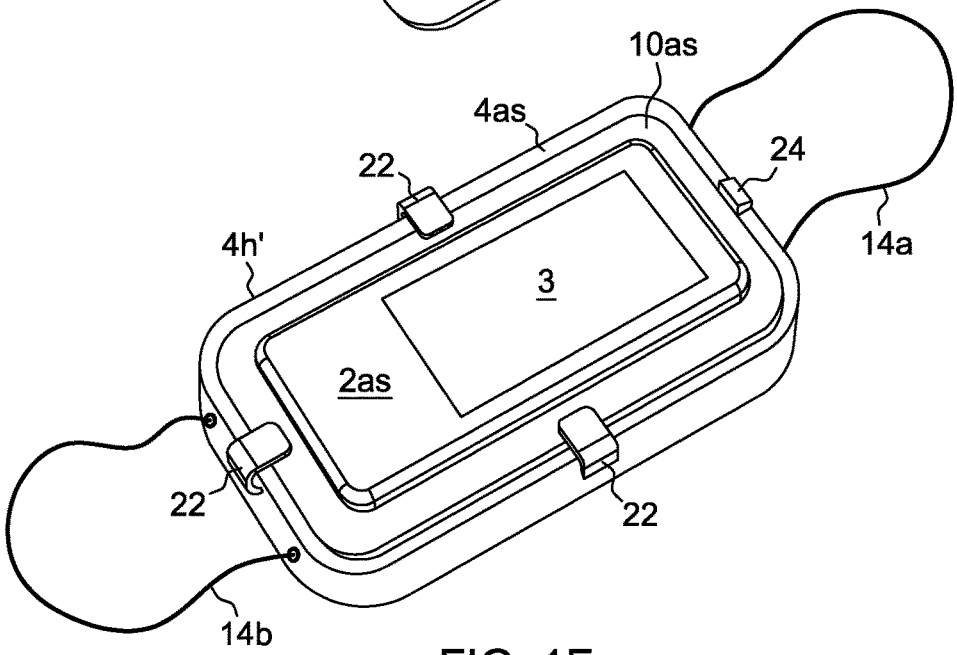
FIG. 1F depicts the backing plate 10 with the hand-held electronic device (e.g., a smartphone) attached to the retractable holder of FIG. 1D.

FIGS. 1E and 1F together depict a backing plate 10 to which the smartphone 2 is attached. The retractable holder 4' (FIG. 1D) may be used to attach or detach a device 2 directly, or alternatively, by first attaching the device to plate 10 (for example, by Velcro as shown in FIG. 1E) and then detachably connecting the plate 10 with the device 2 attached to holder 4'. In more detail, FIG. 1E depicts smartphone 2 fixed to a device-facing surface 10*a* of backing plate 10. FIG. 1F depicts the backing plate 10 with the device 2 attached to the retractable holder 4'.

Please note that while the figures only show the use of the backing plate 10 and device 2 fixed thereon attached to the FIG. 1D embodiment of the retractable holder 4', the invention is not limited thereto. That is, the retractable holder 4' with device 2 may attach to a back surface of the backing plate using Velcro patches 6*a*, 6*b*, instead of adjustable clips 22 and retaining clip 24. For that matter, the device 2 may be detachably connected to the device-facing surface 10*as* by Velcro, or may be more permanently attached using some type of long term adhesive, two-sided tape, preferably with a small foam layer in between the adhesive surfaces of the tape, at the user's option. The invention also includes a commercial package or kit that not only includes one of any of the various inventive holders, but Velcro, glue, replacement parts, such as clips or lanyard cords, etc., without limitation.

The use of the hand-held electronic device 2 fixed to the backing plate 10 rather than directly to the retractable holder allows the user to detach the smartphone/device 2 and the backing plate 10 from the holder(s) 4, 4' and position the device away from the user's body for an alternative use. For that matter, the backing plate may have or be attachable to a mechanism that folds out and operates as a stand, or an extension pole for video (see FIG. 20) to maintain the position of the device 2/plate 10 perpendicular to, or at an acute angle to a surface upon which it is positioned.

Figure 2A:
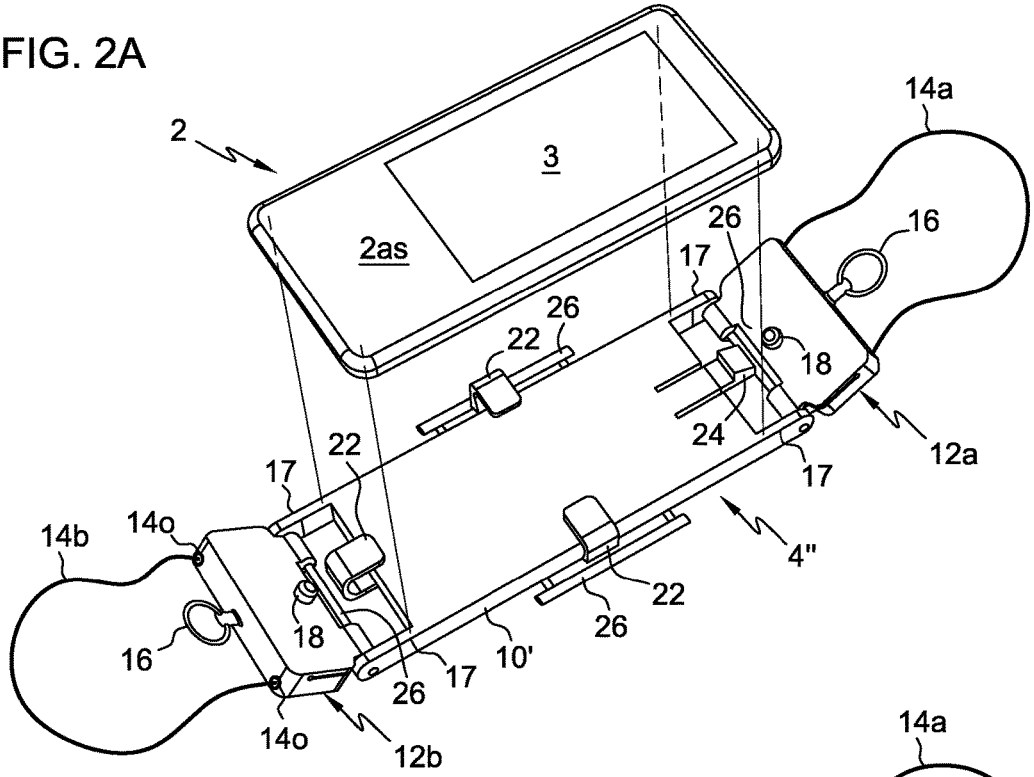
FIG. 2A depicts an embodiment of a retractable holder of the invention, including the hand-held electronic device (e.g., a smartphone) as it is to be attached to the retractable holder.
Figure 2B:
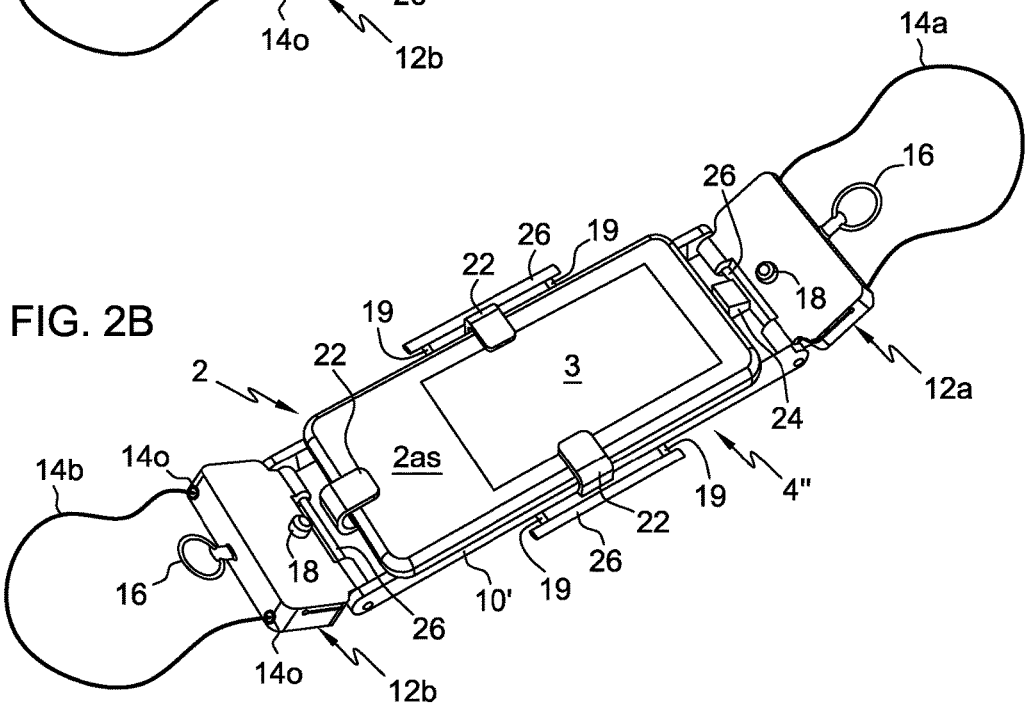
FIG. 2B depict the retractable holder of FIG. 2A with the hand-held electronic device (e.g., a smartphone) attached.

FIGS. 2A and 2B together depict an alternative embodiment of a retractable holder 4" of the invention. The retractable holder 4" comprises a body or backing plate 10' configured to receive a hand-held electronic device 2 via three adjustable clips 22, and a top retaining clip 24 (as explained above). The retractable holder 4" includes first and second reel cartridges 12*a*, 12*b*, including spools 40 with spring-loaded gears or ratchet elements 38 upon which the cords are wound and a lanyard control mechanism. These reel cartridge elements operate together to maintain and enable extraction and retraction of the lanyard cords and, therefore, the respective first and second lanyards 14*a*, 14*b*. Each of the reel cartridges 12*a*, 12*b* (i.e., the reel cartridge housings) are pivotably attached to the backing plate 10', as shown, at pivot axles 26 that extend between legs or extensions 17 of holder plate 10'.

The lanyard control mechanisms of the reel cartridges 12*a*, 12*b* include a ratchet control ring 16, for stopping and releasing the spooling operation of the lanyard cords comprising the first and second lanyards 14*a*, 14*b*. That is, pushing the ring 16 towards the cartridge housing enables pawls to contact teeth on the spool 40/gear 38 and prevent the spool from reeling in the lanyard cord with the ever-present retracting force. Pulling the ring 16 away from the housing prevents the pawls from contacting the teeth and thereby allows the cords to reel with the spring-loaded retracting force (see FIGS. 6A, 6B, 6C). The ring-controlled pawls thereby stop the reeling in, setting the length of a cord, once a lanyard "loop" is fixed at a body location.

Also included in each of the reel cartridges 12*a*, 12*b* is a release button 18, for releasing and attaching the reel cartridges to the pivot axles 26, extending between legs 17 of the backing plate 10'. Please also note a second pair of pivot axles 26 of the sides of the plate 10', proximate opposing clips 22, to which the reel cartridges 12*a*, 12*b* may be affixed in an alternative arrangement. As should be apparent, the second pair of "side" pivot axles 26 is not configured (positioned) to extend between a pair of legs 17, on each end of the plate 10' (as are the end pivot axles 26 and reel cartridges 12*a*, 12*b* shown in FIGS. 2A and 2B), but are connected to the plate 10' by extensions or pins 19, extending from the plate body 10'.

Figure 3A:
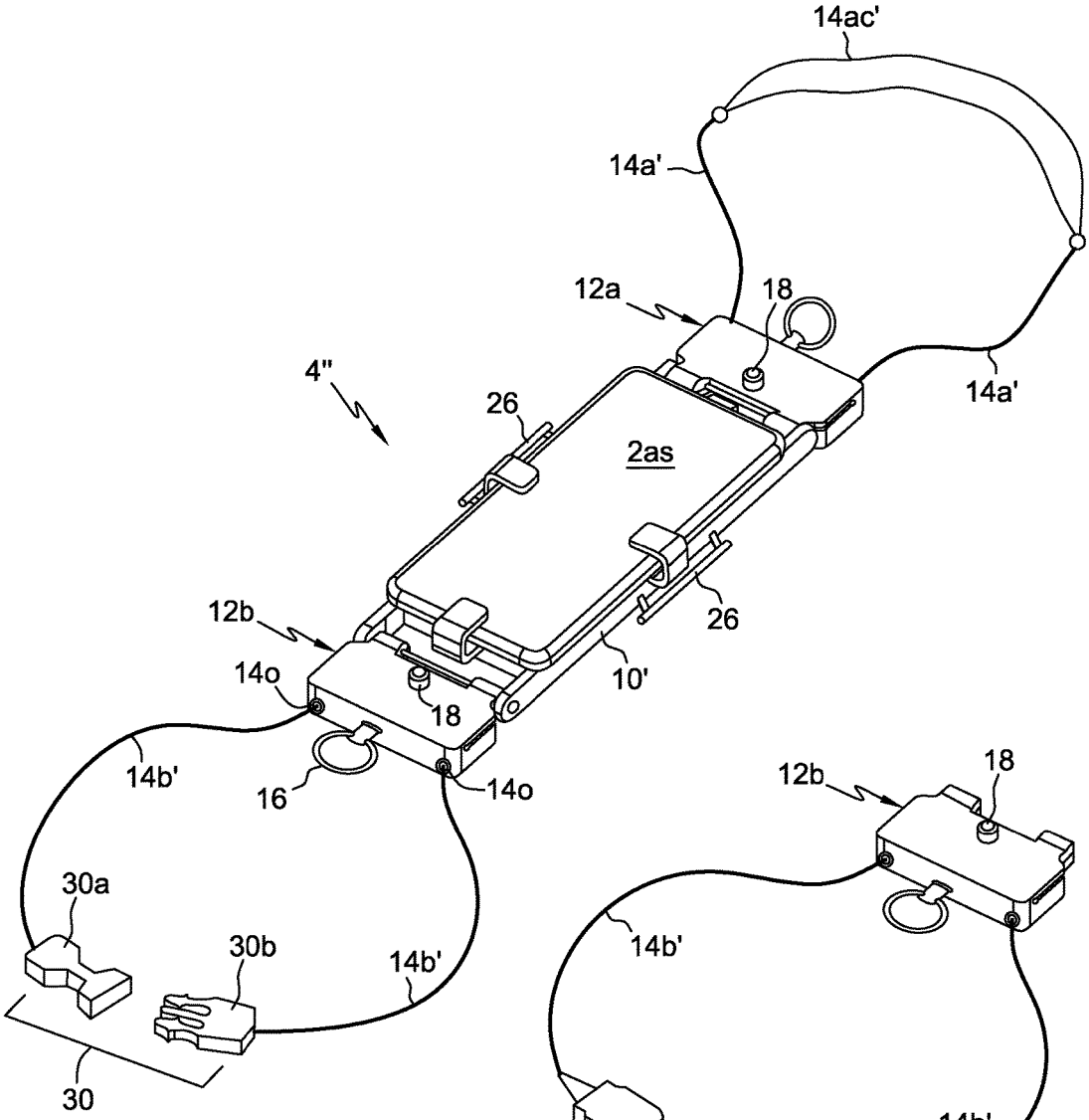
FIG. 3A depicts an embodiment of a retractable holder of the invention where one lanyard includes two separate lanyard cords ending in clips.
Figure 3B:
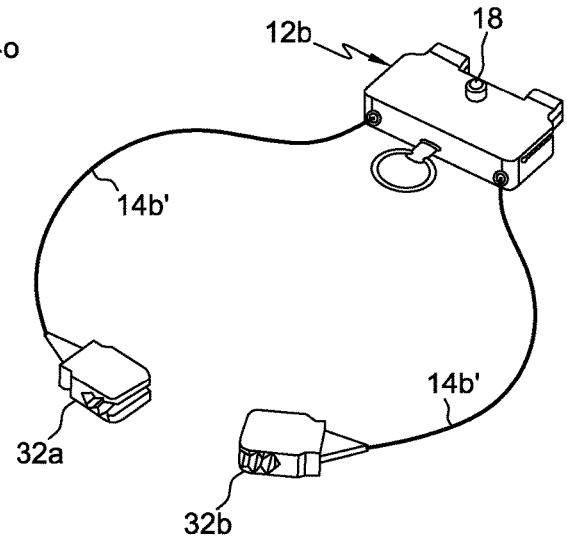
FIG. 3B depicts a variation of the clips on the ends of the lanyard cords first depicted in FIG. 3A.

FIGS. 3A and 3B depict an embodiment of the retractable holder 4" where one lanyard loop, lanyard loop 14*b'*, includes lanyard cords extending from openings 14*o* that are not integrally connected to form the loop, as are the cords of the loops 14*a*, 14*b*. The lanyard cords of loop 14*a'* connect to a cushioning member 14*ac'* at ends and to the reels or spools 40 in reel cartridge 12*a*. Lanyard cords of loop 14*b'* are attached to the reels or spools in reel cartridge 12*b* and at opposite ends, to respective complementary end connectors 30*a* and 30*b*. The length of each of the lanyard cords of loops 14*b'* or 14*a'*, as the case may be, is adjusted by merely drawing out a particular length, in cooperation with ratchet control rings 16. Thereafter, the connector ends 30*a* and 30*b* snap together and are released by squeezing, as should be apparent to the skilled artisan. FIG. 3B shows a variation of the FIG. 3A embodiment, wherein connector ends 32*a* and 32*b* are clips, like alligator clips, configured not only to connect the end of the lanyards cords of loop 14*b'* together but also, to clip directly to a user's, pants, belt, shirt, skirt, etc., as the case may be.

Figure 4:
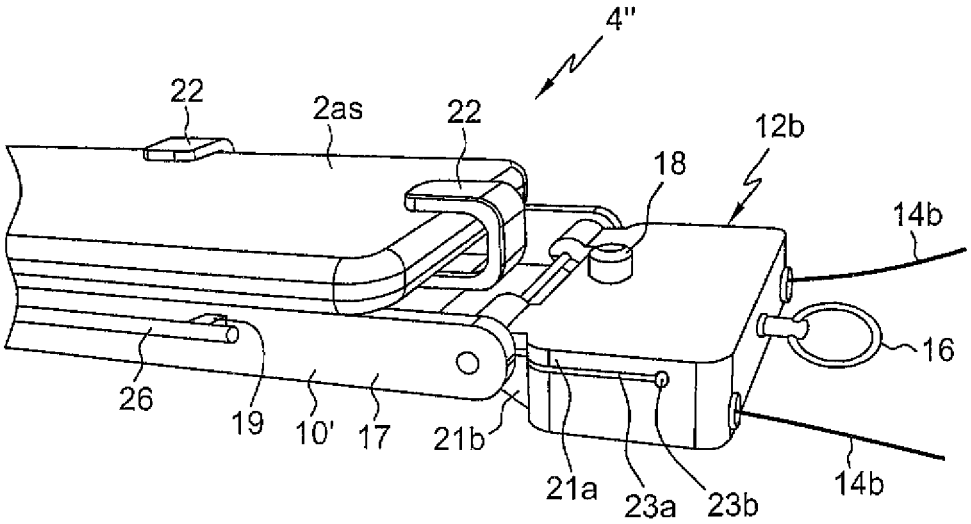
FIG. 4 presents a partial side view of an embodiment of the retractable holder in order to highlight detaching operation of the lanyard reel cartridge (shown attached)
Figure 5:
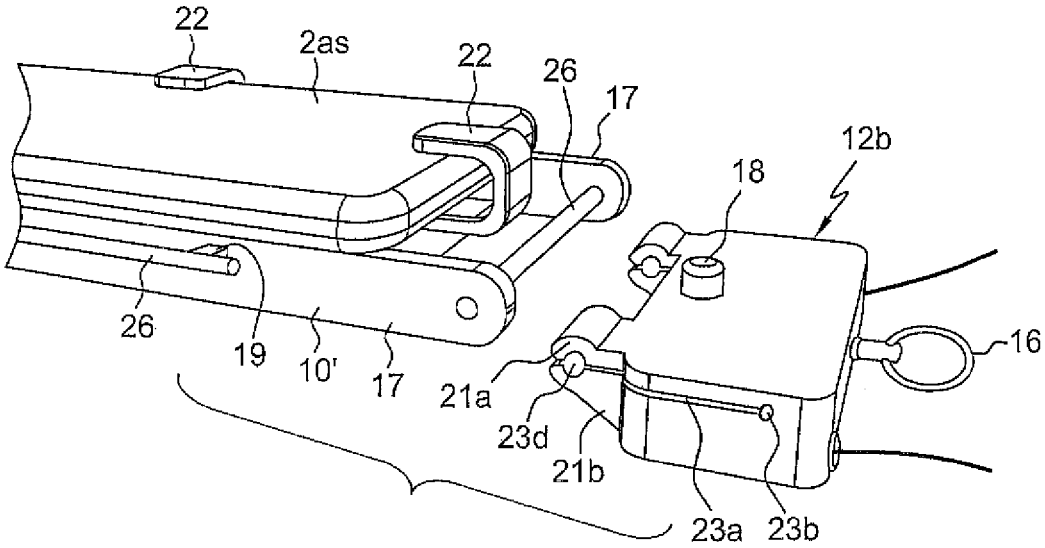
FIG. 5 presents a partial side view of the retractable holder depicted in FIG. 4 with the lanyard reel cartridge not yet attached or disconnected.

FIGS. 4 and 5 depict detaching operation of the reel cartridges 12*a*, 12*b* (only first reel cartridge 12*b* is shown) to the retractable holder 4". That is, by depressing release button 18, the respective upper and lower jaws 21*a*, 21*b* separate vertically in varying degree along the planar cut 23*a* extending partially along the horizontal length of the reel cartridge housing to the opening or through-hole 23*b*. In a sense, the upper and lower jaws 21*a*, 21*b* pivot about through-hole 23*b*. The opening the respective upper and lower jaws 21*a*, 21*b* allows positioning of the pivot axle 26 in a cylindrical opening 23*d*, formed by half-moon shaped cutouts, in the upper and lower jaws (as shown in FIG. 5), which function as a seat for the pivot axles (as shown). The planar cut 23*a*, the through-hole 23*b* and the cylindrical openings 23*d* go from side to side (front to back in the figure). Once the pressure imposed upon the release button 18 (to open the jaws) is withdrawn, the jaws 21*a*, 21*b* spring back (proximately) together as shown in FIG. 4, with the pivot axle 26 seated in cylindrical opening, connecting the assemblies 12*a*, 12*b* to the plate 10' of the retractable holder 4".

Figure 6A:
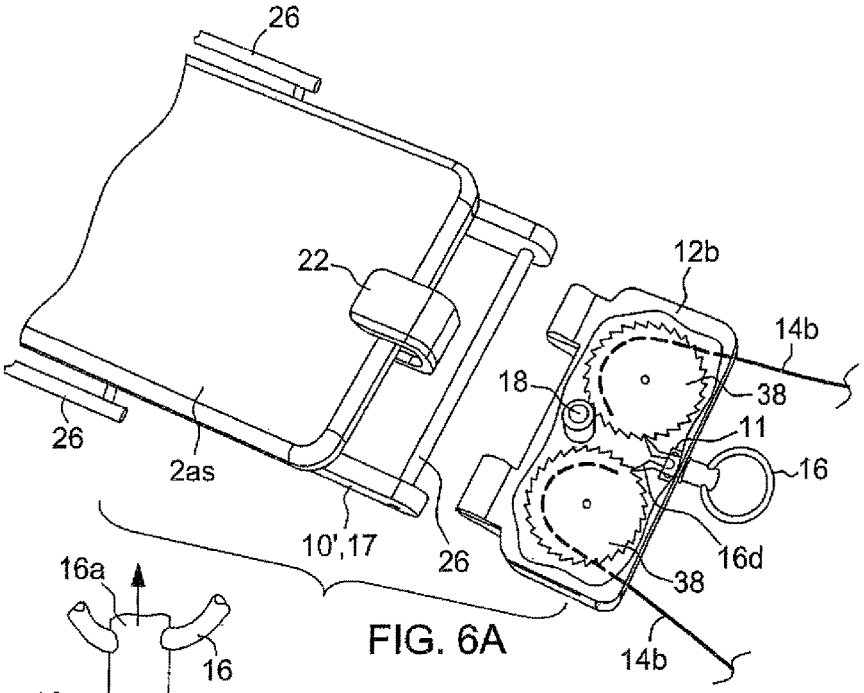
FIG. 6A presents a partial top view of a smartphone inserted into clips on a plate of the retractable holder with a reel cartridge for attachment at an end but not yet connected (or disconnected) from a pivot axle.
Figure 6B:
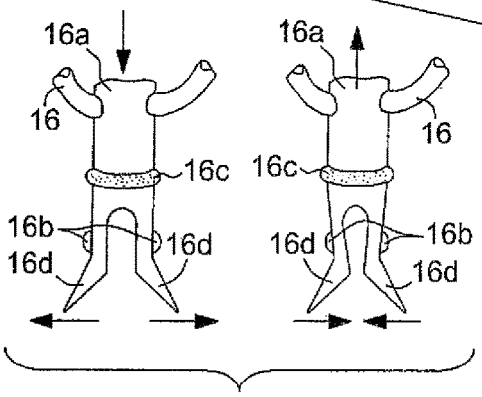
FIG. 6B depicts a ratchet control ring, including a pawl and O-ring integrally formed therewith, to highlight the spring-loaded construction/operation of the pawl with the ratchets to define a lanyard cord length for adjusting positioning of the holder against a user's body.
Figure 6C:
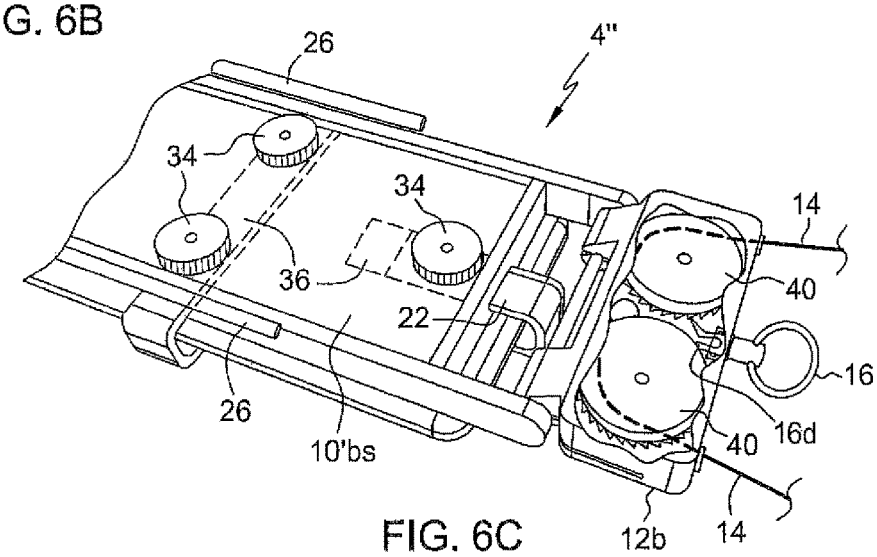
FIG. 6C depicts another side of the plate with the reel cartridge attached at the pivot axle of the holder in order to highlight operation of clips in cooperation with spring-loaded reciprocating clamping knobs with respect to direction limiting channels.

FIGS. 6A, 6B and 6C depict further details of the construction and operation of the reel cartridges 12*a*, 12*b* (only second lanyard reel cartridge 12*b* is shown) in embodiments of the retractable holder 4" that include reel cartridges 12*a*, 12*b* and plates. FIG. 6A shows a portion of a smartphone 2 held via clip(s) 22 on plate 10' with reel cartridge 12*b*, not yet connected (or disconnected) from pivot axle 26.

Each of the reel cartridges includes a pair of spring loaded gears or ratchets 38, connected or integral with spools 40 (see FIG. 17D) for reeling or spooling respective lanyard cord portions within the reel cartridge. The ratchets 38 in each reel cartridge are essentially round gears with teeth attached at one planar surface (at one side) of a spool 40, forming a ratchet/spool combination. A ring 16 is attached or coupled to each reel cartridge 12*a*, 12*b* that is drawn out a small distance to effect enable the cords to reel or pushed into the housing from its extended locking position to lock the pulleys/ratchets 40/38 against reeling with the spring loaded retracting force. Each ring 16 is itself connected to or integral with a body or extension 16*a*.

The body or extension 16*a* extends from the ring itself to a pair of a pivoting, spring-loaded fingers or pawls 16*d*, which engage teeth on each respective gear plate or ratchet 38 (attached to spool 40). The teeth are uniform but asymmetrical, each tooth having a moderate slope on one edge and a much steeper slope on the other edge. When the teeth of ratchets 38 move or rotate (to retract a lanyard cord) in the unrestricted (i.e., forward) direction, by a pulling force applied to a cord, the pawls 16*d* easily slide up and over the gently sloped edges of the teeth, with a spring forcing the pawl (often with an audible 'click') into the depression between the teeth as it passes the tip of each tooth. When the teeth move in the opposite (backward) direction, however, the pawls 16*d* will catch against the steeply sloped edge of the first tooth it encounters, thereby locking the pawl against the tooth and preventing any further motion in that direction.

Detent elements 16*b* are formed on the outer edges of the pawl elements 16*d* that cause the pawls to squeeze together in the direction of the lower arrow on the right side of FIG. 6B, when the pawls are drawn into a small, limited length collar part 110 on the inner housing when the ring 16 is drawn up in the direction of the arrow on the right side of FIG. 6B. But when the rings 16 is pushed into the housing, causing the extension 16*a* and nibs 16*b* on pawls 16*c* to move out of the small collar, the pawls expand apart in the direction of the arrow in the lower left of FIG. 6B, allowing the pawls to lock the teeth. An O-ring 16 prevents the extension 16*a*, detents or nibs 16*b* and pawls 16*d* from moving any further into the housing past the locking position. Preferably, the inside of the collar 110 has indents for two nibs at two positions, in which the pawls lock and the pawls unlock. Also preferably, the extension part 16*a* has a stop means or collar thereon that prevents the pawls from being pulled out of the housing by a pulling force on ring 16.

That is, pushing the ring 16 in the direction of the down arrow (left side of FIG. 6B) pushes the pawls 16*d* inwardly away from the collar disengaging the force on the nibs squeezing the pawls, allowing the pawls to expand against the ratchet teeth for a lock. Pulling the ring 16 away from the housing in the direction of the up arrow (right side of FIG. 6B) pulls the pawl portions with the nibs 16*b* into the collar part, which squeezes the pawls with respect to one another in the direction of the horizontal arrows in the bottom right of FIG. 6B, away from the teeth. The lanyard cord(s) therefore retract onto the ratchet/spool 38/40 by the return spring force, which spins to reel the lanyard cord. Please note, however, that in the locked state against reeling, a lanyard cord may still be drawn from one or both spools/ratchets 40/38, to extend and adjust one or both of the cord lengths and, therefore, the placement of the retractable holder in a fixed location against the user's body.

FIG. 6C shows the other side of the plate 10' with the reel cartridge 12*b* attached at pivot axle 26, in order to highlight operation of the adjustable clips 22 in cooperation with clamping knobs 34 and movement channels. Clamping knobs 34 are spring loaded (in the embodiment shown) and reciprocate within direction limiting-channels 36 to both move and lock the position of adjustable clips 22. In their fixed state, the adjustable clips essentially receive an edge of the device (e.g., smartphone) 2 when it is slid laterally into a position on the retractable holder when retaining clip 24 is in its depressed state. Please note that the adjustable clips 22 with spring-loaded clamping knobs 34 and clip 24 represent only one exemplary means for fixing the smartphone/device 2 in place on the plate 10', where other means for attachment may be implemented by those of skill in the art without deviating from the scope and spirit of the invention.

Figure 7A:
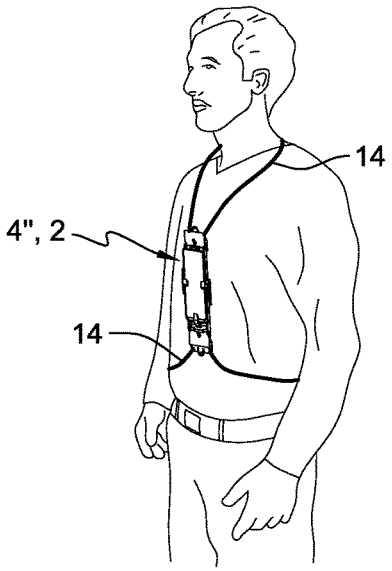
FIG. 7A depicts operation of a retractable holder to highlight use of the inventive holder with the reel assemblies connected at holder ends and the lanyard cord ends connected to holder clipped together at the neck and waists of a user.
Figure 7B:
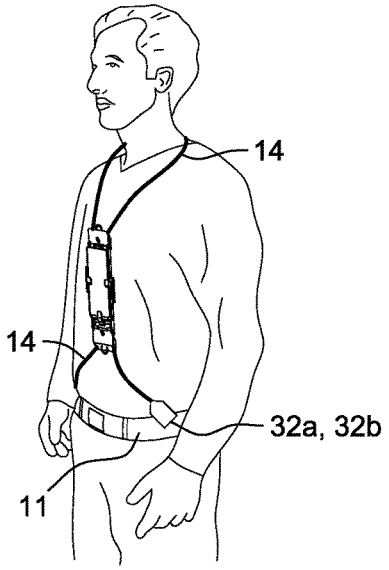
FIG. 7B depicts operation of a retractable holder to highlight use of the retractable holder with lanyard ends clipped together at the neck and the belt or belt loops of a user.

FIGS. 7A-E depict the retractable holder 4" (FIGS. 2A, 2B, 3A, 3B, 4, 5, 6A-C) to highlight one manner of using that inventive embodiment, i.e., where the reel cartridges 12*a*, 12*b* are connected at the ends of the plate 10' rather than the sides. FIGS. 7A and 7B, in particular, show the retractable holder 4" with device/phone 2 in hands free mode, fixed to the user's chest at the position defined by the amount of lanyard cord extending from the respective ratchets 38. The 4 adjustable lengths pull the combined weight of the retractable holder and phone at four points, two related to each respective lanyard 14*a*, 14*b*. In hands free mode, the holder/phone is drawn/fixed against the user's body (again, based on the four lengths), enabling the wearer can perform all types of tasks without concern for his/her hand-held device 2 swinging free and interfering with his/her task at hand.

Figure 7C:
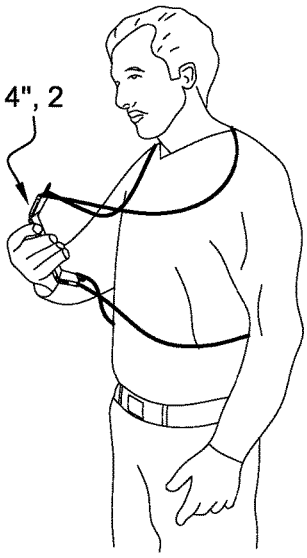
FIG. 7C depicts operation of the retractable holder to highlight use that a user may grasp and extend the retractable holder away from his/her body, from its stationary held position where the lanyards cords are slack.
Figure 7D:
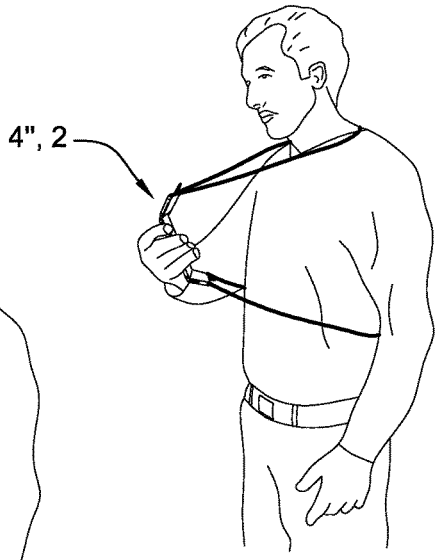
FIG. 7D depicts operation of the retractable holder to highlight where the lanyards cords are taught.
Figure 7E:
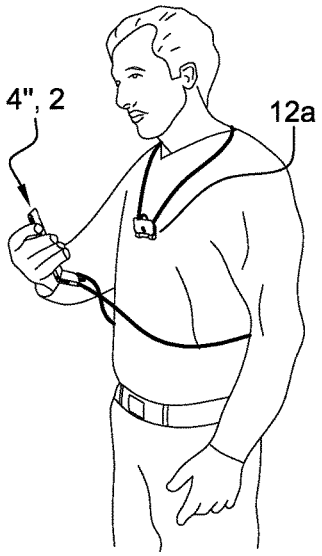
FIG. 7E depicts operation to highlight that the retractable holder may be separated from one or the other of the lanyard assemblies and lanyards for convenient handling.
Figure 7F:
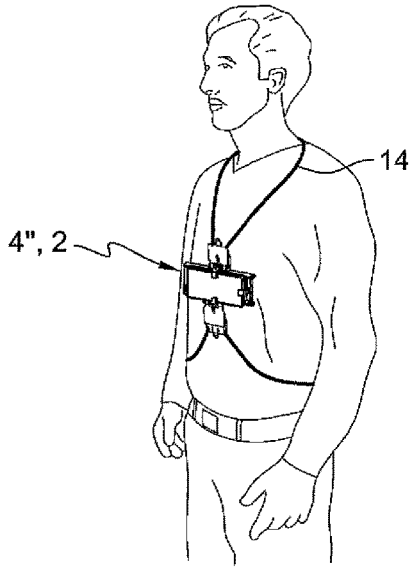
FIG. 7F depicts operation of a retractable holder to highlight use of the inventive holder with the reel assemblies connected at holder sides and the lanyard cord ends connected to holder clipped together at the neck and waists of a user.
Figure 7G:
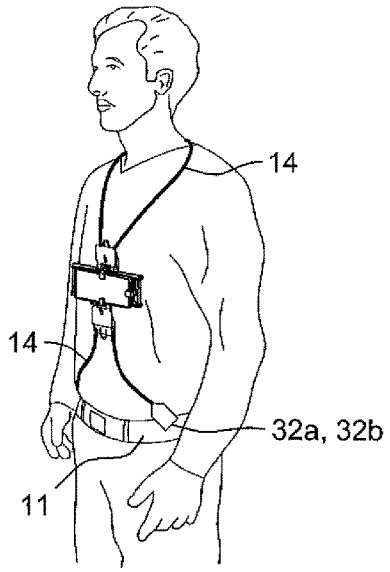
FIG. 7G depicts operation of a retractable holder to highlight use of the with lanyard ends clipped together at the neck and the belt or belt loops of a user.
Figure 7H:
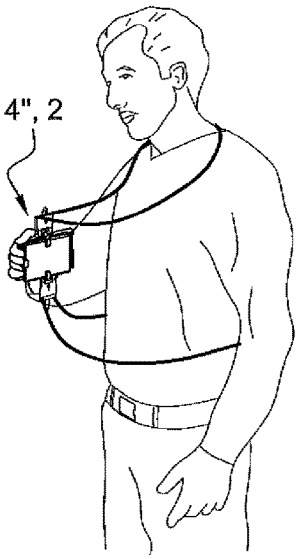
FIG. 7H depicts operation of the retractable holder to highlight a user grasping and extending the retractable holder away from his/her body, from its stationary held position where the lanyards cords are slack.
Figure 7I:
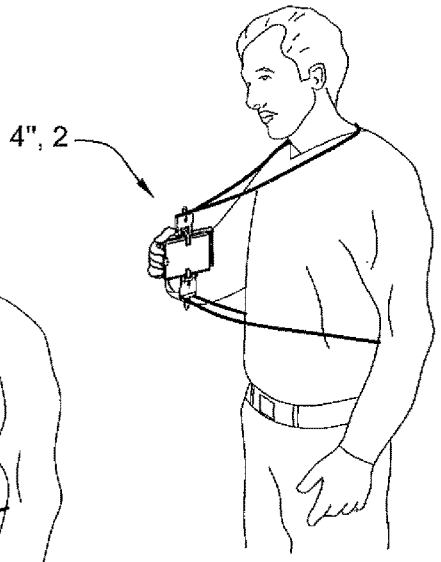
FIG. 7I depicts operation of the retractable holder to highlight where the lanyards cords are taught.
Figure 7J:
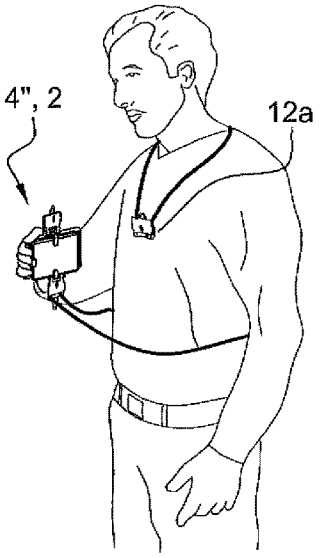
FIG. 7J depicts operation to highlight that the retractable holder may be separated from one or the other of the lanyard assemblies and lanyards for convenient handling.

The hand-held device or smartphone 2 is fixed in the retractable holder 4", which is in turn fixed by the a let set for each of the two cords of each of the first and second lanyard loops 14*a*, 14*b*, the lanyard loops so formed positioned at two body locations. For example, the lanyard loops may be attached/positioned about the user's neck and waist. For that matter, the waist loop may be formed by either merely wrapping the loop around his/her waist (see FIG. 2A), clipped around his/her waist (see FIG. 3A) or clipped to his/her belt or trousers 11 (see FIG. 3B). FIGS. 7C-E highlight the use mode, wherein the user grasps the retractable holder 4" in order to use the attached device/phone 2. In FIGS. 7C and 7D, the user merely draws more of the lanyard (slack), where in FIG. 7E, the user disconnects the first reel cartridge 12*a*, for additional reach and positioning. The retractable holder 4" with device/phone 2 is then either drawn back to the position central to the user's chest, as shown, by the retracting tension, or reconnected to the first reel cartridge 12*a*.

FIGS. 7F-J depict operation of retractable holder 4" where the reel cartridges 12*a*, 12*b* are connected at the sides of the plate 10' rather than the ends. The reader should note that while the inventive embodiments operate to fix the retractable holders 4, 4', 4", 4'" against a user's body, at two opposing sides of the holder, and at two adjustable lanyard cord lengths at each of the two opposing sides, the invention is not limited to the embodiments shown. Alternative embodiments may be implemented by those of skill in the art, as long as the retractable holder is drawn and held against the body at a fixed position according to the fixed length on two sides or ends, and a fixed length of the cords extending from two parts that are proximate the corners, of both sides or ends, for example, using the harness depicted in FIGS. 19A and 19B, without deviating from the scope and spirit of the invention.

Figure 7K:
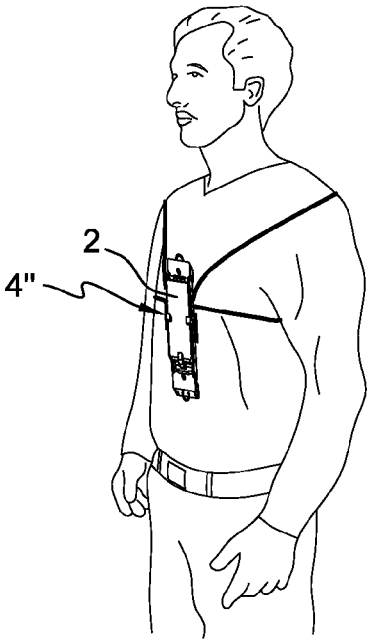
FIG. 7K depicts operation to highlight that the holder and lanyard loops may be used as a harness, to position the holder on the chest of a user.
Figure 7L:
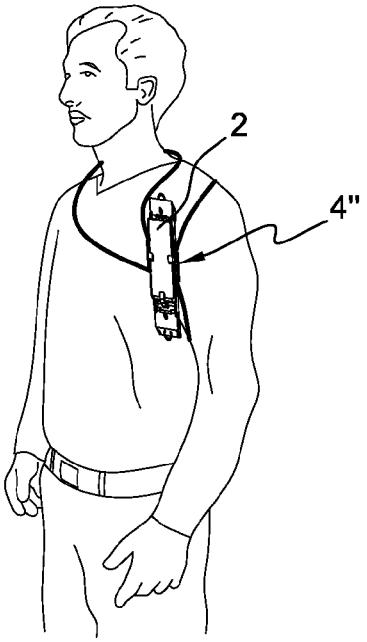
FIG. 7L depicts operation to highlight that the holder and lanyard loops may be used as a harness, to position the holder on the chest of a user.

FIGS. 7K and 7L are included to highlight that the holder and lanyard loops may be used as a harness, to position the holder and device at respective positions on the chest and shoulder of a user.

FIGS. 8-15 depict another retractable holder 4''' of the invention, which is similar to but more compact than the retractable holder 4, depicted in FIGS. 1B, 1D, 1E and 1F. Retractable holder 4'' comprises a holder housing 42, which houses and includes spools 40, connected or otherwise integral with spring loaded gears or ratchets 38, about which retractable lines or lanyard cords whose respective lengths define each of the 4 fixation points of the holder are spooled (for example, see FIG. 17D, below).

Figure 8:
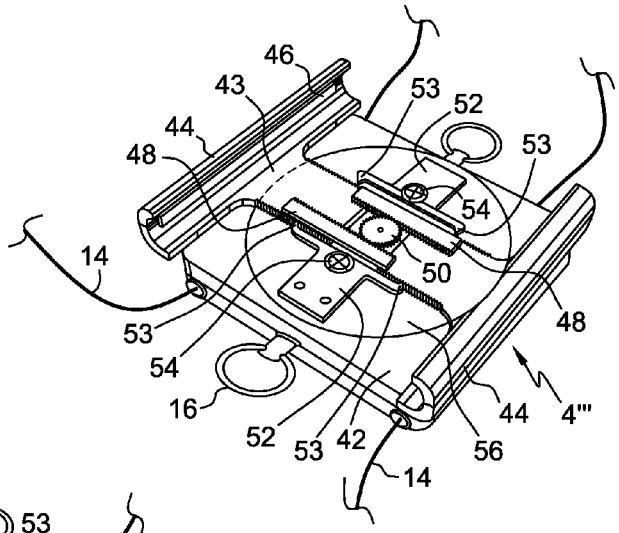
FIG. 8 depicts another retractable holder of the invention, which is similar to but more compact than the retractable holder 4, depicted in FIGS. 1B, 1D, 1E and 1F.
Figure 9:
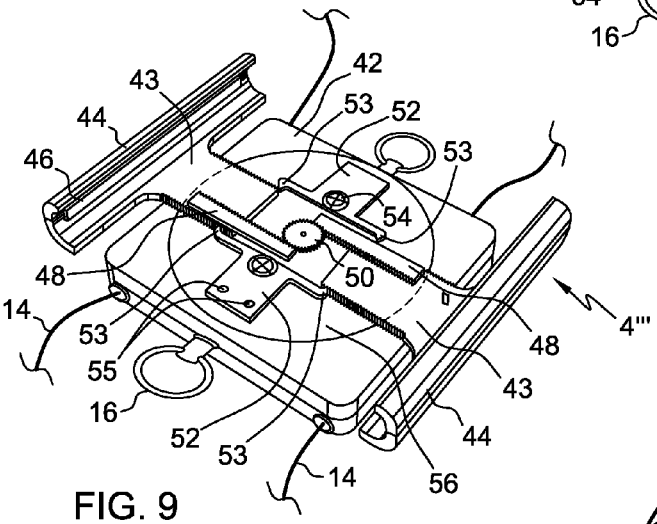
FIG. 9 depicts the retractable holder of FIG. 8, where the side rails are open in order to receive a hand-held electronic device.
Figure 10:
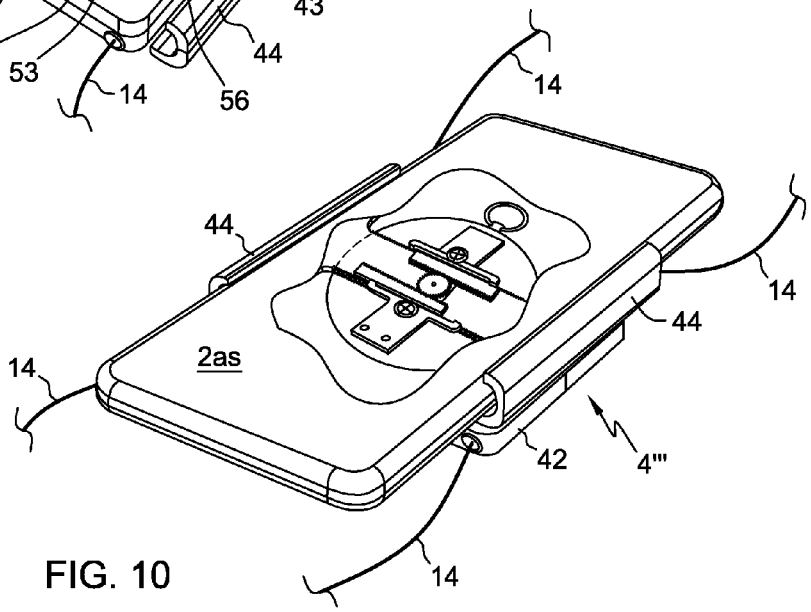
FIG. 10 depicts the retractable holder of FIGS. 8 and 9, grasping and holding a hand-held electronic device.

The retractable holder 4''' includes means for connecting and disconnecting a hand-held electronic device 2 thereto, as depicted in detail in FIGS. 8, 9 and 10. The means for connecting and disconnecting includes inter alia a circular rotatable pivot plate 56 which is rotationally connected at its axial center at the axial central of the holder housing 42. The rotatable pivot plate 56 is configured to rotate about the axial center of the holder housing 4*h*'''', off the outer housing surface, in fixed angular steps, for example, of 1° (see FIGS. 11-13).

Side or gripping rails 44 that are caused to pivot and grasp the device 2, and pivot back to release the device 2, are attached via an extension portion 43 to an upper surface of the rotatable pivot plate 56, when a device is pressed into and between the rails. The side or gripping rails 44 operate in a sense like jaws, as explained further hereinbelow. The attached device 2 can thereby rotate about the retractable holder's central rotating axis once a device is gripped and the holder is fixed in place at a body location by cooperation of the positioned lanyard loops and user-defined length of each of the four lanyard cords.

The means for connecting and disconnecting enables that the distance between the side rails 44 is adjustable to accommodate devices 2 with varying widths and depths. The side rails 44 are formed with an arm or extension portion 43, which has gear teeth and which extends inwardly from a lower portion of each rail 44 towards the center of the holder 4'''. The arm or extension portion 43 is formed as a substantially planar member configured with a side rack 48 on one side upon its upper device-facing surface. It is not significant upon which side of the arm or extension portion 43 that the side rack 44 is positioned, as long as the side rack on the other arm or extension portion 43 is positioned on its other side, as shown in FIGS. 8 and 9. For that matter, each side or gripping rail 44 preferably includes friction pads 46 that function as non-slipping agents, for slidingly receiving the side edges of the devices 2 seated and grasped therein.

The side rack 48 of each arm of extension portion 43 (and therefore, each side rail 44) moves in cooperation with a distributing and centralizing alignment gear 50 (which is seated upon and affixed at the axial center of the circular rotatable pivot plate 56). The alignment gear teeth synchronize with and align with the teeth of the side rack, allowing movement with a force applied (typically by hand) to move the gripping rails and arm or extension portions, by engagement with the respective side racks 48. The movement controls the separation distance between the device-facing surfaces of the gripping rails 44, to accommodate various hand-held electronic devices.

The means for connecting and disconnecting also includes locking pawl plates 52 fastened to a device-side surface of the rotating pivot plate 56 by rivets or welds 55 on one end of a rectangular member. On the other end of the rectangular member (opposing the end fastened by the rivets or welds 55), a pair of claw-like arms extend perpendicularly away from the rectangular member and each other. At respective ends of the arms are disposed locking pawls 53 configured to engage teeth found in respective edges of the extension portions 43 extending from the gripping rails 44 (when pressed by a device), as shown.

The locking pawl plates 52 are configured so that the locking pawl end spring up from the surface of rotating pivot plate 56 (in a normal state), essentially pivoting from the connection points 55. The locking pawls 53, therefore, normally are not engaged with teeth along the sides of the extension portions 43 (see FIG. 14D). This allows the extension portions 43 to move back and forth with respect to the axial center of the gear 50, the plate 56 and the retractable holder 4''', limited only by operation of side racks 48. Buttons 54 on each locking pawl plate 52 stand off the pawl plate surface proximate the arms at which the pawls 53 are positioned. When the pawl plate 52 is pushed down against the buttons 54, the locking pawls 53 meshes with the teeth on the sides of the extension portions 43, preventing further lateral movement.

In greater detail, a pushing force down upon the hand-held electronic device or smartphone 2 when positioned in the holder 4''' (in the direction of the down arrow in FIG. 14B) results in a contact force against the buttons 54 and the pawl plate 52. The pawl plate 52 moves against the spring force holding it up (at the end with the locking pawls 53), causing the pawls 53 to slide against, lock into and enmesh with the teeth of the extension arms 43, which sets the position of the arms and, therefore, the gripping rails 44. This downward force of the device against the means for connecting and disconnecting cause the rails 44 to grasp and hold the device 2 while also causing the teeth of side racks 48 to engage the teeth of the respective side racks 48, fixing the phone/device 2.

Figure 11:
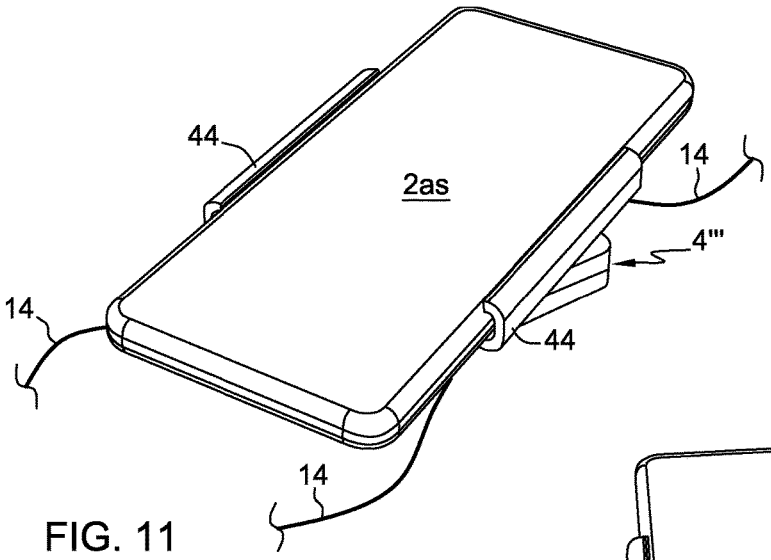
FIG. 11 depicts the retractable holder of FIGS. 8, 9, 10, grasping and holding a hand-held electronic device, to highlight the ability to rotate the device with respect to the holder.
Figure 12:
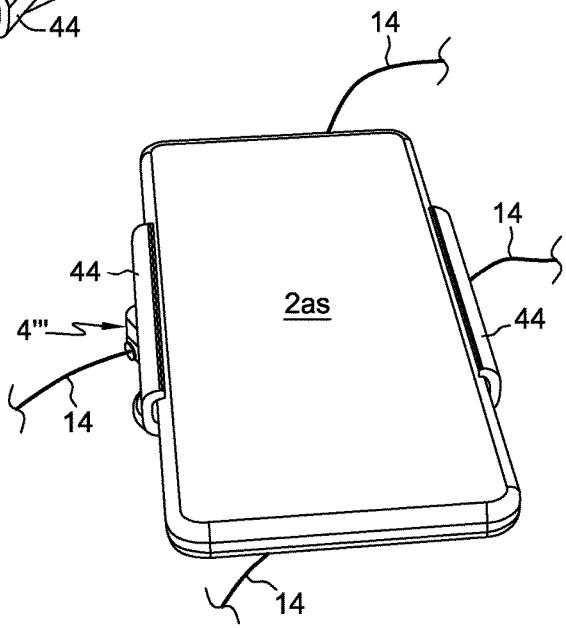
FIG. 12 depicts the retractable holder of FIG. 11 to highlight the ability to rotate the device with respect to the holder.
Figure 13:
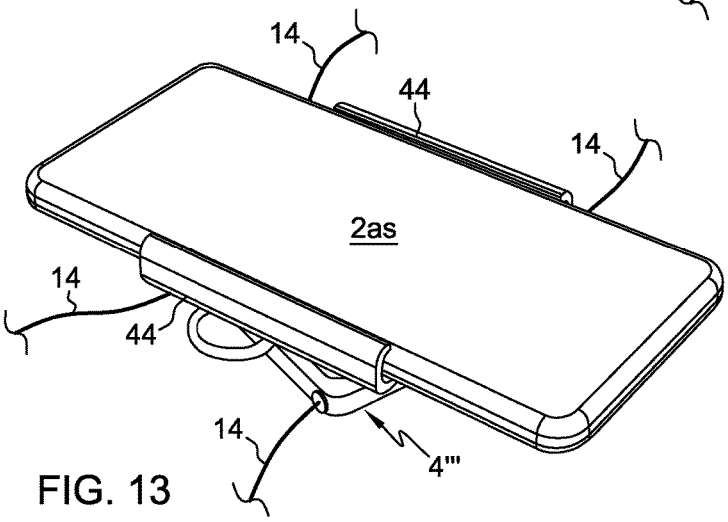
FIG. 13 depicts the retractable holder of FIGS. 11 and 12 to highlight the ability to rotate the device with respect to the holder.

FIG. 11 depicts the retractable holder 4''' of FIGS. 8, 9, 10, grasping and holding a hand-held electronic device, to highlight the ability to rotate the device with respect to the holder; FIG. 12 depicts the retractable holder 4''' of FIG. 11 to highlight the ability to rotate the device with respect to the holder; and FIG. 13 depicts the retractable holder 4''' of FIGS. 11 and 12 to highlight the ability to rotate the device with respect to the holder.

FIGS. 14A and 14B present side views of the retractable holder 4'''. FIG. 14A shows the holder 4''' where the device 2 (e.g., phone) is not engaged and clasped by gripping rails 44, that is, the device has not been pressed down, in a direction opposite of the arrow in FIG. 14A. FIG. 14B shows the device 2 (e.g., phone) engaged with gripping rails 44, that is, the device has been pressed down in a direction of the arrow in FIG. 14B.

As explained above with reference to FIGS. 8-10, in order to fix the device 2 in the holder 4''', the device is placed between the gripping rails 44 in the means for connecting and disconnecting, and the rails 44 are pushed together against the sides of the device, guided by central gear 50 enmeshed with the teeth of the side racks 48. To then grasp and hold the device in place, the device is pressed downwards (FIG. 14B is arrow), which causes the pawls 53 of locking pawl plates 52 to mesh with the teeth on the sides of the extension portions 53 to move down towards and against the plate 56, enmeshing the pawls 53 with the teeth and causing the rails 44 to slightly pivot in and grasp and hold the device. The means for connecting and disconnecting then essentially "click" in place. To release, a small separating force is applied to the device and the holder, respective (unclick).

FIG. 15 provides a perspective partial cutaway view of the retractable holder 4''' to provide a more detailed view of the elements comprising inter alia the means for attaching. While the means for connecting and disconnecting holder 4''' may be said to be responsive to a pushing force downwards to fix the gripping rail 44 position while the rails are slightly pivoted to grasp the phone, the embodiment may be modified slightly in that a central rod aligned with the axial center of the gear 50, plate 56 and holder 4''' and connected with the gear at one end and connected to a grasping knob on its other end, under the holder, is rotated clockwise, or counterclockwise draw the means for connecting and disconnecting slightly downward to the position shown in FIGS. 10 and 14B.

Figure 16A:
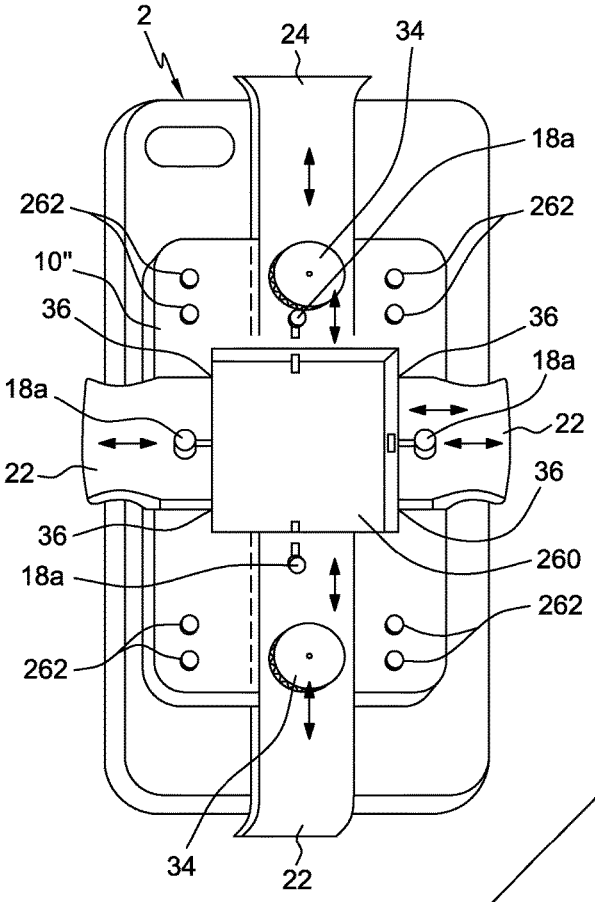
FIG. 16A depicts a backing plate and means for connecting the backing plate (and device if attached) to a reel cartridge assembly (shown in FIG. 16B), where the backing plate and reel cartridge assembly comprise another embodiment of the invention.
Figure 16B:
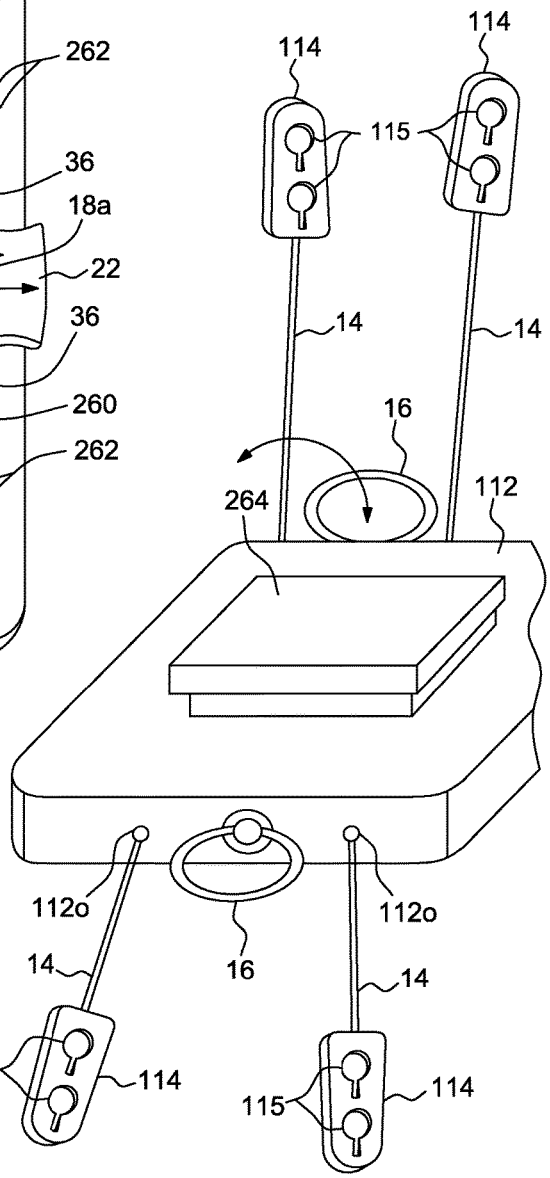
FIG. 16B depicts a reel cartridge assembly for attachment to the backing plate of FIG. 16A.

FIGS. 16A and 16B together depict another embodiment of a retractable holder 4'''' with device/phone 2 attached as shown. Retractable holder 4'''' comprises two parts. The first part is a backing plate 10" with means for connecting and disconnecting a hand-held electronic device 2, including clips 22, 24, clamping knobs 34 (FIG. 16A). The second part is a holder housing assembly 112 for the retractable placement of the holder 4'''' at a body location (FIG. 16B). The backing plate 10" and holder housing assembly 112 connect and disconnect from each other by complementary attachment means, 260 and 264.

Figure 17B:
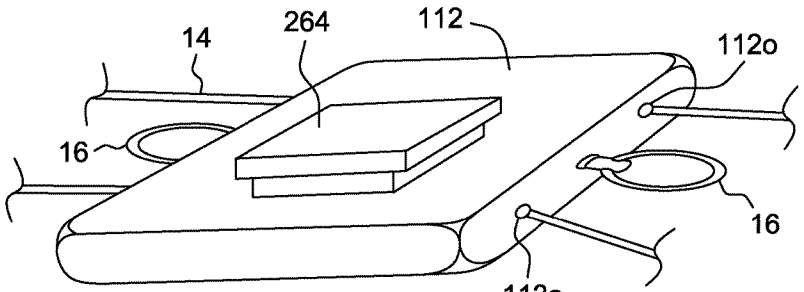
FIG. 17B depicts the cartridge assembly of FIGS. 16B, 17A in a side perspective view.

That is, the respective complementary attachment means comprises a female attachment element 260 that is rotatingly affixed to the plate 10" and means for connecting and disconnecting, as shown in FIG. 16A. The plate 10" is configured with at least 4 buttons or standoffs that connect to openings 115 in connectors 114. The female attachment means 260 is configured to complement and receive a male attachment means 264 (FIG. 16B), which is press fitted into the female attachment means 260. The male attachment means 264 is fixedly attached to the holder housing assembly 112. As shown, lanyards 114 extend from openings 112*o* to female connectors 114, which are each configured with openings 115 as shown. FIGS. 17A and 17B show the holder housing assembly 112 and male attachment means 264 in a top plan view and a side perspective view.

Figure 17C:
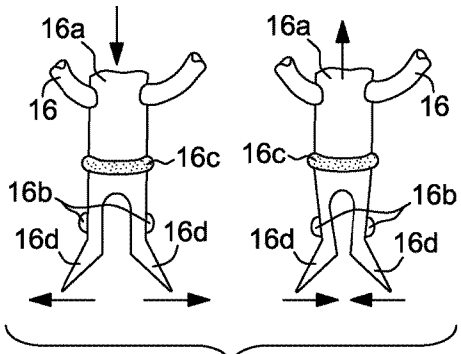
FIG. 17C depicts pawls connected to rings for engaging and disengaging the four spring loaded ratchet/spool combinations of FIG. 17D.

FIG. 17C shows the rings 16 that are attached or coupled to the holder housing assembly 112. Each ring 16 is itself connected to or integral with a body or extension 16*a*. The body or extension 16*a* extends from the ring itself to a pair of a pivoting, spring-loaded fingers or pawls 16*d*, which engage teeth on each respective gear plate or ratchet 38 (attached to spool 40). The teeth are uniform but asymmetrical, each tooth having a moderate slope on one edge and a much steeper slope on the other edge. When the teeth of ratchets 38 move or rotate (to retract a lanyard cord) in the unrestricted (i.e., forward) direction, by a pulling force applied to a cord, the pawls 16*d* easily slide up and over the gently sloped edges of the teeth, with a spring forcing the pawl (often with an audible 'click') into the depression between the teeth as it passes the tip of each tooth. When the teeth move in the opposite (backward) direction, however, the pawls 16*d* will catch against the steeply sloped edge of the first tooth it encounters, thereby locking the pawl against the tooth and preventing any further motion in that direction.

Detent elements 16*b* are formed on the outer edges of the pawl elements 16*d* that cause the pawls to squeeze together in the direction of the lower arrow on the right side of FIG. 17C, when the pawls are drawn into a small, limited length collar 110 part on the inner housing when the ring 16 is drawn up in the direction of the arrow on the right side of FIG. 17C. But when the rings 16 is pushed into the housing, causing the extension 16*a* and nibs 16*b* on pawls 16*c* to move out of the small collar, the pawls expand apart in the direction of the arrow in the lower left of FIG. 17C, allowing the pawls to lock the teeth. An O-ring 16 prevents the extension 16*a*, detents or nibs 16*b* and pawls 16*d* from moving any further into the housing past the locking position. Preferably, the inside of the collar 110 has indents for two nibs at two positions, in which the pawls lock and the pawls unlock. Also preferably, the extension part 16*a* has a stop means or collar thereon that prevents the pawls from being pulled out of the housing by a pulling force on ring 16. Alternatively, the O-ring can be the stop means.

That is, pushing the ring 16 in the direction of the down arrow (left side of FIG. 17C) pushes the pawls 16*d* inwardly away from the collar disengaging the force on the nibs squeezing the pawls, allowing the pawls to expand against the ratchet teeth for a lock. Pulling the ring 16 away from the housing in the direction of the up arrow (right side of FIG. 17C) pulls the pawl portions with the nibs 16*b* into the collar part, which squeezes the pawls with respect to one another in the direction of the horizontal arrows in the bottom right of FIG. 17C, away from the teeth.

Figure 17D:
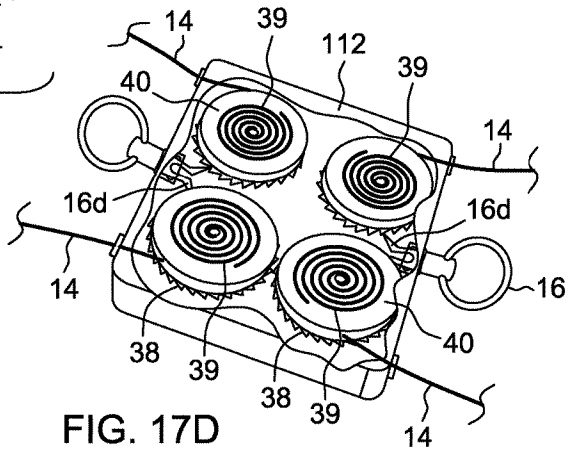
FIG. 17D shows the cartridge assembly to highlight the spring loaded ratchet/puller combinations and operation.
Figure 17A:
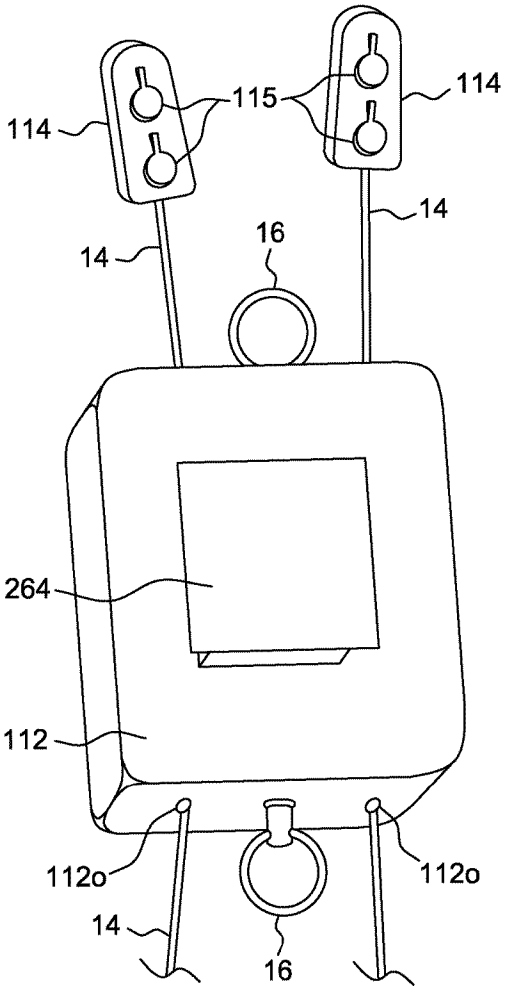
FIG. 17A depicts the cartridge assembly of FIG. 16B and male attachment means in a top plan view.

The lanyard cord(s) therefore retract onto the spool 40 (to which is attached gear or ratchet plate 38) by the return spring force of spring elements 39, which are connected to the spool 40 or gear plate 38 to reel the lanyard cord (see FIG. 17D). Please note, however, that in the locked state against reeling (ring 16 pushed in to allow pawls 16*d* to expand and contact teeth of gear plates 38), a lanyard cord may still be drawn from one or both spools to extend and adjust one or both of the cord lengths and, therefore, the placement of the retractable holder in a fixed location against the user's body.

The female connectors 114 affixed to the ends of the respective lanyard cords are configured with openings 115 to receive standoffs or buttons 117 extending vertically off the face of the male connector 116 for insertion into openings 115 of female connectors 114, as shown in FIGS. 18A-D, or buttons 262 extending off the body-facing surface of plate 10" (FIG. 16A). The male connectors 116 may be formed as part of belt loops 118 (see plan and side views in FIGS. 18A and 18B, respectively), for connection to the openings 115 in respective female elements 114 of the second lanyard 14, without limitation.

Figure 18A:
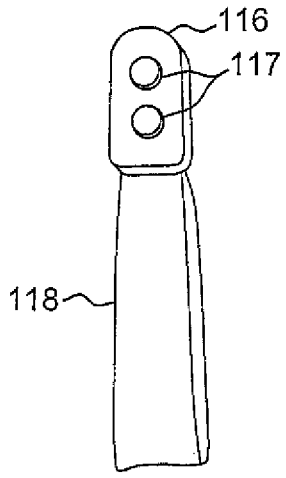
FIG. 18A depicts a belt connector for attachment to a lanyard connector.
Figure 18B:
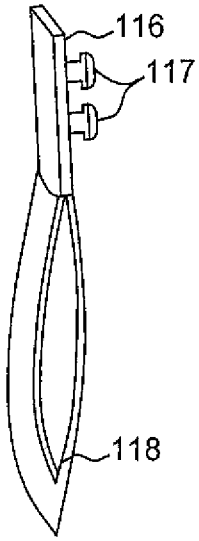
FIG. 18B depicts a side view of the belt connector of FIG. 18A.
Figure 18C:
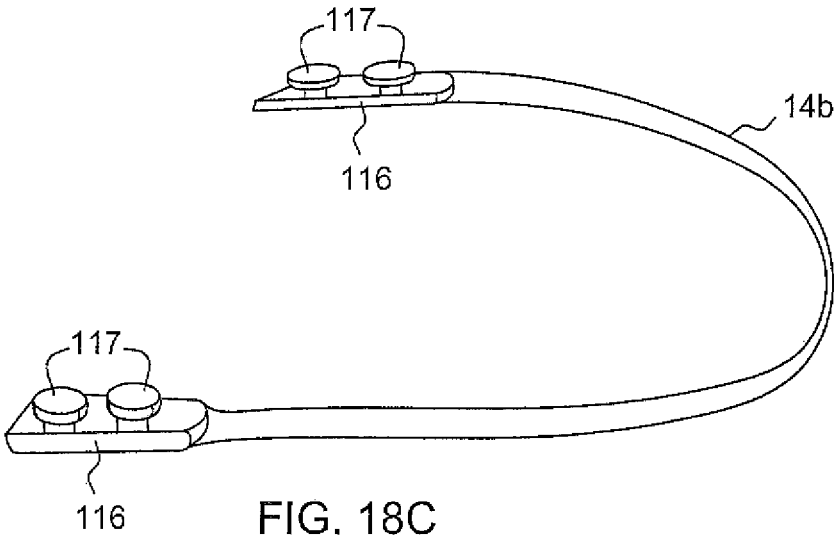
FIG. 18C depicts a lanyard with connectors of FIGS. 16A and 16B connected at opposing ends.
Figure 18D:
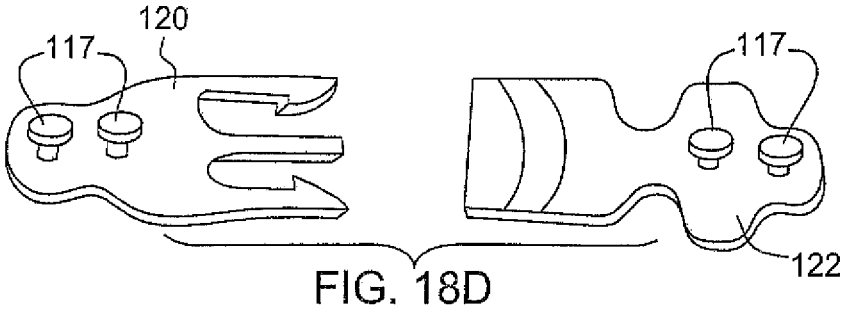
FIG. 18D depicts cooperating male and female connectors.

FIG. 18C depicts a neck lariat 14*b* (functioning as a first lanyard loop) to which are attached male connectors 116 with buttons 117 at respective ends for attachment to female connectors 114 (FIG. 17A) of the elements of lanyard cords 14. FIG. 18D depicts cooperating male 120 and female 122 connectors, each mounted with male buttons 117. The embodiments of FIGS. 18A, 18B, 18C and 18D, are disclosed to provide some examples of means for connecting the lanyard (or harness) ends together or to a user's clothing or body, but are not meant to be limiting in any way. The invention may be configured with any means know to the skilled artisan for connecting lanyard or harness ends together or to a piece of clothing or apparel, without deviating from the scope and spirit of the invention.

Figure 19A:
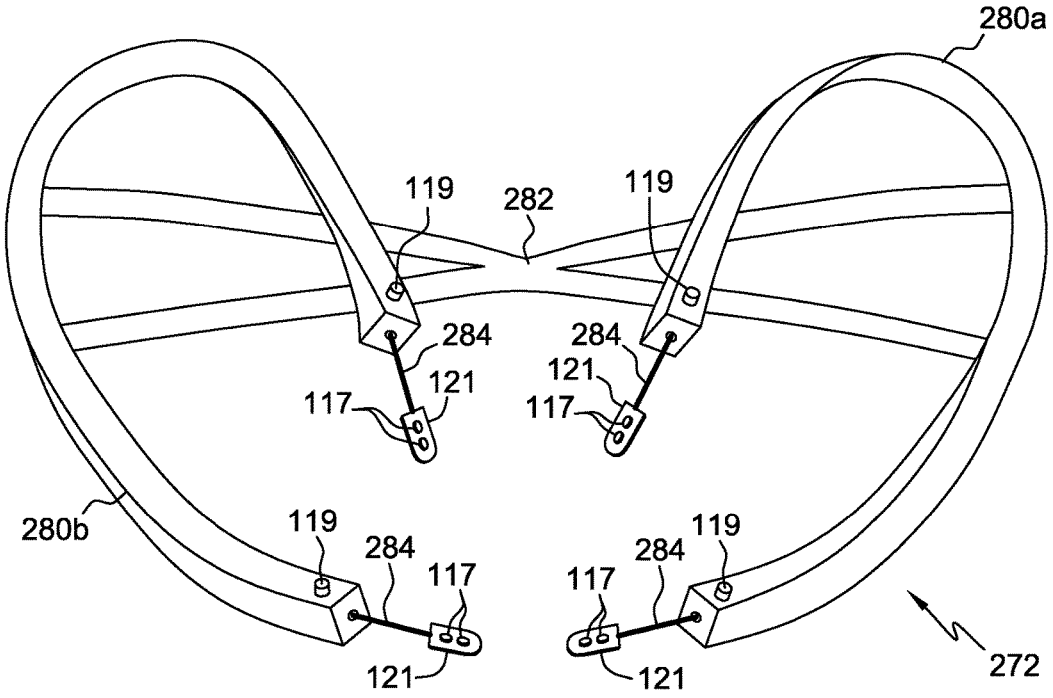
FIG. 19A depicts a harness that may be used with the retractable holder of the invention.
Figure 19B:
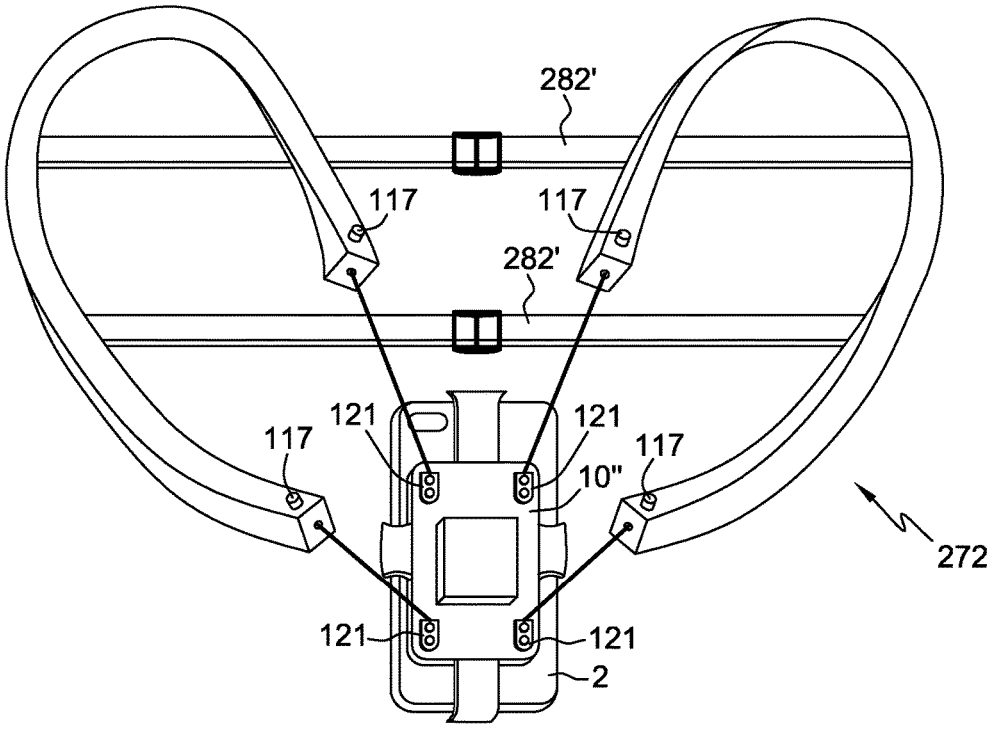
FIG. 19B depicts the harness of FIG. 19A connected to a holder of the invention.

FIGS. 19A and 19B together depicts an alternative embodiment of the cartridge assembly 112, shown in FIG. 16B and FIGS. 17A-D, in the form of a harness 272, for retractably holding the plate 10" with means for connecting and disconnecting a hand-held electronic device 2, including clips 22, 24, clamping knobs 34 and, therefore, the device 2 attached to the plate 10", as shown in FIG. 16A and described above.

Harness 272 includes first and second straps 280*a*, 280*b*, interconnected by at least one connecting member 282 in one or more connecting points along the lengths of the respective first and second straps. Preferably, the connecting member 282 is stretchable to allow the user to comfortably arrange the harness 272 about his/her body, where the stretchable material with which the connecting member 282 is formed, when stretched, applied a correcting force to return the connecting member 282 to its unstretched shape. And while the connecting member 282 is shown in an "x" configuration and, connected thereby to the first and second straps 280*a*, 280*b*, at two positions on each strap, the embodiment as shown is for exemplary purposes only and the first and second straps 280*a*, 280*b* may be connected together in any arrangement known or considered by the skilled artisan without deviating from the scope and spirit of the invention.

Each of first and second straps 280*a*, 280*b* includes cords 284 that extend and retract from a retraction mechanism configured to carry out the retracting and extending, and housed proximate each respective strap end. Preferably, the retraction mechanisms comprise spools that are spring loaded to provide a retracting return force when the cord is pulled out against the return force. The retracting return force operates to reel back in any extended cord 284, to hold the plate 10" when attached, and when the harness is worn, against the user's/wearer's body.

Most preferably, the retraction mechanisms include a stop (actuated by actuator pins 119), that allows maintaining a fixed length of the cord 284 after it is drawn out against the spring-loaded retracting force, to hold the cord at the fixed length against the return force. One example of such a retraction mechanism includes a ratchet/spool arrangement, similar to those described above. Each of the respective ends of the first strap 280*a* and the second strap 280*b* are configured with connectors 121 that comprise one or more buttons 117 for connecting to openings 115 in connectors 114 or openings 262 in plate 10".

Figure 20A:
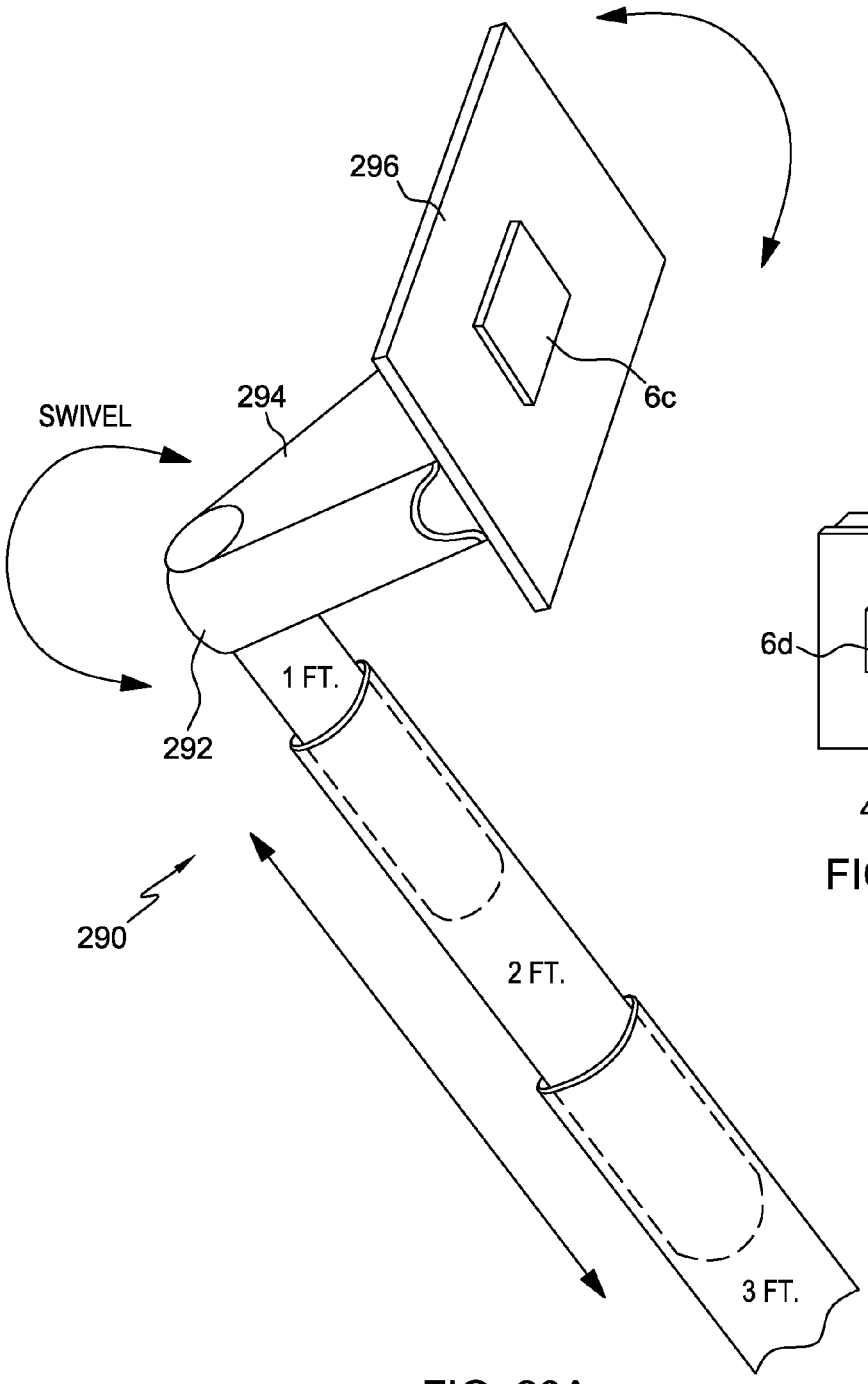
FIG. 20A presents an extension stick to which an inventive retractable holder may be attached for hands free operation to capture photographs or streaming video.
Figure 20B:
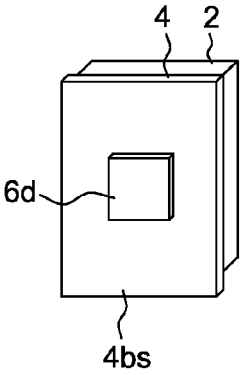
FIG. 20*b* shows a retractable holder arranged to attach to the extension stick of FIG. 20A.

FIG. 20 presents an extension stick 290 to which a holder 4, similar to the holders depicted of FIGS. 1C-1E, may be attached. The stick 290 has a swivel joint with a member 294 that ends to a plate 296 fitted with a Velcro patch 6*c*. The holder 4 includes a Velcro patch 6*d* on its back surface 4*bs*, opposite the device-facing surface 4*as*, for connecting the holder to the plate. The stick 290, holder 4 and Velcro patches 6*c* and 6*d* allow for hands free operation of the device, in particular, while capturing photographs or streaming video, or merely collecting audio data using device 2 attached to the holder 4.

Figure 21B:
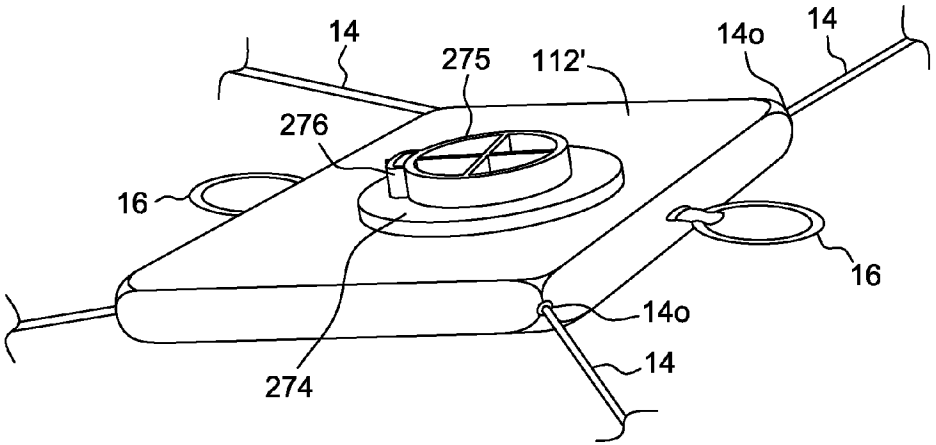
FIG. 21B depicts a side view of the holder housing assembly 112' and means for rotatable attachment to either on a backing plate or directly to a hand-held electronic device.
Figure 21A:
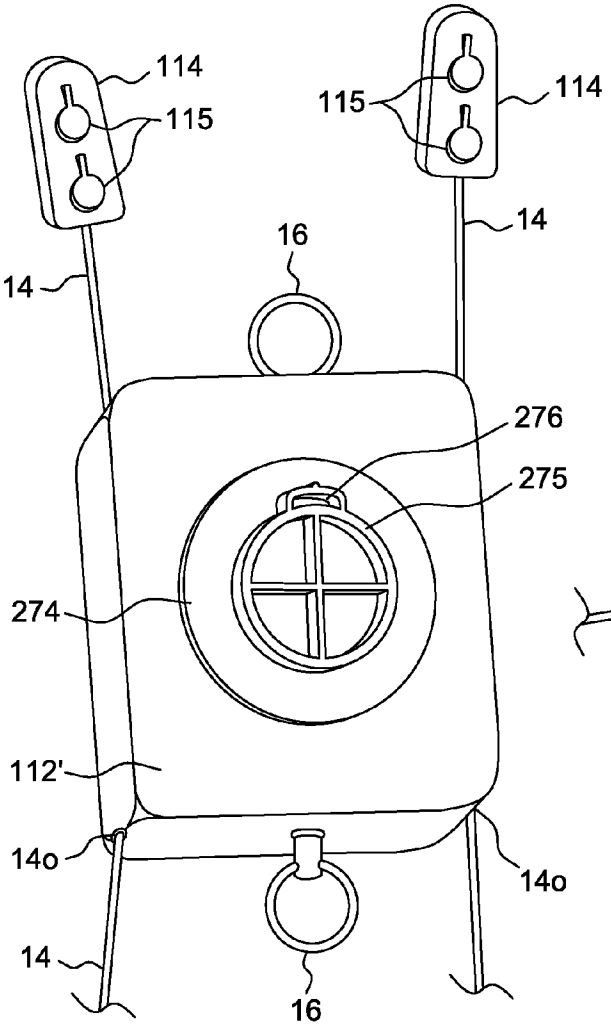
FIG. 21A depicts a plan view of an alternative holder housing assembly 112' that is configured with means for rotatable attachment to either on a backing plate or directly to a hand-held electronic device.

FIGS. 21A and 21B depict a plan and side view respectively of an alternative holder housing assembly 112'. The housing assembly 112' is configured with a male part 274 of a means for rotatable attachment to either on a backing plate 10, 10', 10" or a hand-held electronic device. The male part 274 of means for rotatable attachment includes a round cylindrical extension 275, which extends substantially perpendicularly away from the surface of the holder to be received in a round cylindrical cavity 283 of a female part 284 of the rotatable attachment means, and mate therewith. The round cylindrical extension 276 includes a locking member 276 extending radially off the outer circumference of the cylindrical extension 275, which is received in a like locking opening 286, extending radially out from the circumferential boundary of round cylindrical cavity 283.

For that matter, the round cylindrical cavity 283 also includes a circumferential inner channel 285, that extends radially (and contiguously away from the outer circumferential boundary of round cylindrical cavity 283. The circumferential inner channel 285 is contiguous with the locking opening 286, has like radial dimensions and is below and outer surface 287 of the female part 284 (see FIG. 21C). To connect the male part 274 to the female part 284, the locking member 276 is aligned with the locking opening 286, and then the male part 274 is turned or rotated so that it is captured within some portion of the circumferential inner channel 285 (away from the locking opening). The locking member 276 slides in a radial direction within circumferential inner channel 285 or pathway.

Figure 21D:
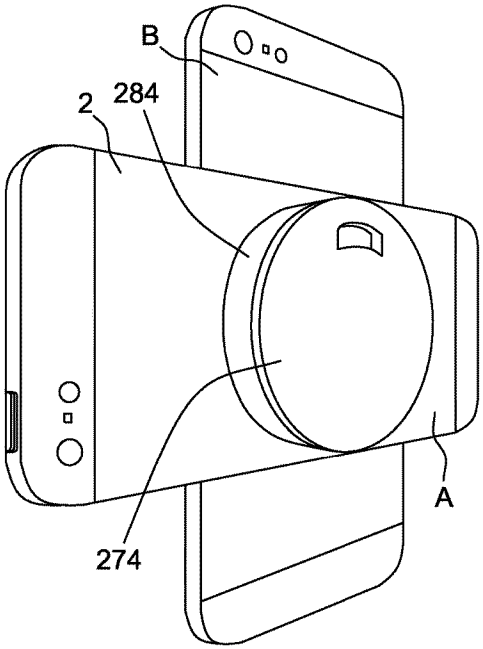
FIG. 21D depicts a side perspective view both complementary parts of means for rotatable attachment connected only to the device.
Figure 21E:
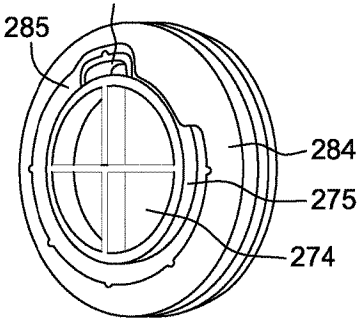
FIG. 21E depicts a partial cutaway view of the both complementary parts of the means for rotatable attachment, where neither of the parts is connected to a device or holder.
Figure 21C:
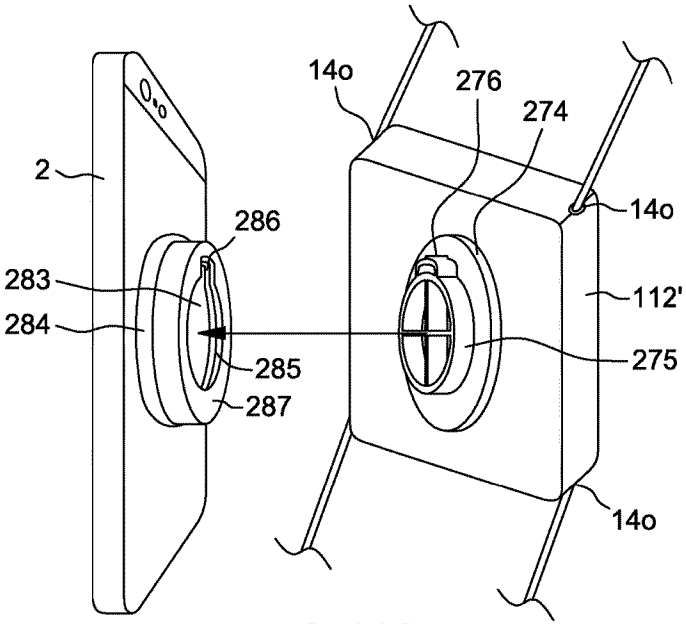
FIG. 21C depicts a side view of the holder housing assembly 112' and a device 2, to highlight the complementary means for rotatable connection directly on the device.

FIG. 21D highlights the device 2, attached to the female part 284 of the rotatable attachment means (with male part 274 connected) in a first position A, and in a second position B, after the device 2 and female part 284 has been rotated 90° with respect to the male part 274. FIG. 21E depicts a partial cutaway view of the both complementary male 274 and female 284 parts of the means for rotatable attachment to further highlight locking member 275 in channel 285 of the female part 284, where neither of the parts 274, 284 are connected to a device or holder.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A retractable holder for a hand-held electronic device, comprising:

a housing with a device-facing surface and a body-facing surface;

means for connecting and disconnecting a hand-held electronic device to the device-facing surface of the housing;

a first lanyard loop comprising lanyard cords that are reeled onto or deployed from cord storage spools located inside the housing; and a second lanyard loop comprising lanyard cords that are reeled onto or deployed from cord storage spools located inside the housing;

wherein each of the cord storage spools are spring-loaded to apply a retracting force to reel any of the lanyard cords extending from the housing in a deployed state into the cord's respective cord storage spool, wherein the cord storage spools each include a spool ring lock that operates to prevent the spools' respective lanyard cords from being retracted from the respective cord's deployed extended state, and wherein each of the cord storage spools is configured to enable a user to draw out and deploy a fixed length of the lanyard cord, by applying a drawing force in excess of the retracting force and by actuating the respective spool ring lock.

2. The retractable holder as set forth in claim 1, wherein the cord storage spools include a gear device, with gear teeth on an outer circumferential surface, that is attached to or integral with the spools and wherein the spool ring lock locks the gear device to prevent the cord storage spools from turning with the retracting force and unlocks the gear device to enable the cord storage spools to turn with the retracting force and reel the deployed lanyard cord.

3. The retractable holder as set forth in claim 2, wherein the spool ring lock includes pawls that engage the gear teeth on the gear device to lock the spool and prevent reeling the retracting force and disengage the gear teeth to unlock the spool and enable reeling with the retracting force.

4. The retractable holder as set forth in claim 3, wherein the spool ring lock includes a ring connected to the pawls and configured to be drawn away from the housing to disengage the pawls from the gear teeth and pushed into the housing to engage the pawls to the gear teeth.

5. The retractable holder as set forth in claim 1, wherein the means for connecting and disconnecting comprise substantially cylindrical male and female parts, that are fixed to the housing and device respectively, and which cooperate to interlock while allowing for sliding rotational movement of the male part with respect to the female part.

6. The retractable holder as set forth in claim 1, wherein the means for connecting and disconnecting further comprises a rotatable pivot plate mounted to the device-facing surface of the housing upon which the gripping rails are operatively arranged.

* * * * *